US006827638B2

(12) United States Patent
Kiuchi et al.

(10) Patent No.: US 6,827,638 B2
(45) Date of Patent: Dec. 7, 2004

(54) POLISHING DEVICE AND METHOD

(75) Inventors: Etsuo Kiuchi, Gunma (JP); Toshiyuki Hayashi, Gunma (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 189 days.

(21) Appl. No.: 09/926,243

(22) PCT Filed: Jan. 29, 2001

(86) PCT No.: PCT/JP01/00568

§ 371 (c)(1),
(2), (4) Date: Sep. 28, 2001

(87) PCT Pub. No.: WO01/56742

PCT Pub. Date: Aug. 9, 2001

(65) Prior Publication Data

US 2002/0187728 A1 Dec. 12, 2002

(30) Foreign Application Priority Data

Jan. 31, 2000 (JP) ..... 2000-22591

(51) Int. Cl.[7] ..... B24B 7/00

(52) U.S. Cl. ..... 451/287; 451/397; 451/398; 451/402

(58) Field of Search ..... 451/41, 285–289, 451/402, 397, 398, 390

(56) References Cited

U.S. PATENT DOCUMENTS 4,313,284 A * 2/1982 Walsh ..... 451/288
4,450,652 A * 5/1984 Walsh ..... 451/7
4,457,114 A * 7/1984 Hennenfent et al. ..... 451/53
4,471,579 A * 9/1984 Bovensiepen ..... 451/7
5,036,630 A * 8/1991 Kaanta et al. ..... 451/41
5,127,196 A * 7/1992 Morimoto et al. ..... 451/7
5,718,620 A * 2/1998 Tanaka et al. ..... 451/288
5,775,980 A * 7/1998 Sasaki et al. ..... 451/285
5,873,769 A * 2/1999 Chiou et al. ..... 451/7
6,121,144 A * 9/2000 Marcyk et al. ..... 438/692
6,386,957 B1 * 5/2002 Masumura et al. ..... 451/59
6,416,384 B1 * 7/2002 Kawamoto et al. ..... 451/7
6,475,068 B1 * 11/2002 Jimbo et al. ..... 451/57

FOREIGN PATENT DOCUMENTS

JP 54-54390 4/1979

OTHER PUBLICATIONS

Abstract of Japanese Patent Publication No. 07052034A; dated Feb. 28, 1995.
Abstract of Japanese Patent Publication No. 10296619A; dated Nov. 10, 1998.
Abstract of Japanese Patent Publication No. 10094957A; dated Apr. 14, 1998.
Abstract of Japanese Patent Publication No. 60201868A; dated Oct. 12, 1985.
Abstract of Japanese Patent Publication No. 57096767A; dated Jun. 16, 1982.
Abstract of Japanese Patent Publication No. 06124931A; dated May 6, 1994.

* cited by examiner

*Primary Examiner*—M. Rachuba
(74) *Attorney, Agent, or Firm*—Arent Fox

(57) ABSTRACT

There are provided a polishing apparatus and a polishing method capable of performing polishing a work (such as a wafer) with high efficiency and high precision, a novel work holding plate effectively holding a work and an adhering method for a work capable of adhering the work on the work holding plate with high precision. The polishing apparatus comprises: a polishing table(29); and a work holding plate (38), wherein a work held on the work holding plate(38) is polished supplying a polishing agent solution(41) in the apparatus, and in polishing action, an amount of deformation of the polishing table(29) in a direction normal to an upper surface thereof with respect to the upper surface thereof and/or an amount of deformation of the work holding plate(38) in a direction normal to a work holding surface thereof is restricted to 100 $\mu$m or less by forming the polishing table(29) in one-piece, contriving flow paths of cooling water and others.

9 Claims, 22 Drawing Sheets integrated heat quantity control flow chart

A : polishing cloth surface temperature
B : polishing agent solution return temperature ($S_6$)
C : polishing agent solution supply temperature ($S_1$)

polishing agent solution supply rate 30 l/min

A : polishing cloth surface temperature
B : polishing agent solution supply temperature
C : polishing agent solution return temperature
D : polishing table cooling water supply temperature
E : polishing table cooling water return temperature integrated heat quantity control flow chart

POLISHING DEVICE AND METHOD

TECHNICAL FIELD

The present invention relates to a polishing apparatus and a polishing method capable of performing polishing of a work, for example, a silicon wafer (hereinafter may be simply referred to as "wafer") or the like with high efficiency and high precision, a novel work holding plate for holding a work (for example, a wafer or the like) in a efficient way and a method for adhering a work onto the work holding plate.

BACKGROUND ART

Reflecting a tendency to prepare larger diameter silicon wafers and fabricate higher precision devices therewith, requirements for finish precision (thickness uniformity, flatness and smoothness) of a silicon wafer subjected to polishing finish (polished wafer) have been increasingly enhanced.

In order to satisfy such requirements, efforts have been made to attain a higher level in wafer polishing technique, and development and improvement of polishing apparatuses have been carried out.

As one example thereof, so-called single wafer polishing apparatuses have been newly developed for the purpose of polishing a large diameter wafer, especially 300 mm or more in diameter, and some of them have been practically used.

In the single wafer polishing method, however, there arise problems: for example, (1) requirements for reduction in wafer cost is hard to meet in terms of productivity, and (2) recent requirements for wafer flatness as far as an peripheral area adjacent to the wafer edge (within 2 mm) cannot be sufficiently satisfied.

Meanwhile, there has been widely used a batch type polishing apparatus in which a plurality of wafers are simultaneously polished. An outline of a configuration of a portion of the apparatus directly associated with polishing action is shown in FIG. 19. In this polishing apparatus, one or more wafers W are held by means of such as adhesion on a lower surface of a work holding plate 13 rotated by a rotary shaft 18; to-be-polished surfaces of the wafers W are pushed, for example, using a top weight 15 onto a surface of a polishing cloth 16 adhered on an upper surface of a polishing table 10, which is rotated at a prescribed rotational speed by a rotary shaft 17; and a polishing agent solution (hereinafter may be referred to "slurry") 19 is simultaneously supplied at a prescribed rate onto the polishing cloth 16 through a polishing agent supply pipe 14 from a polishing agent supply device (not shown). In such a situation, polishing of the wafers W are performed while the to-be-polished surfaces of the wafers W are rubbed by the surface of the polishing cloth 16 in the presence of the polishing agent solution 19 therebetween.

In this batch type polishing apparatus, there is increasing difficulty in satisfying requirements for precision of finish surfaces of the wafers in a trend of transition to larger-sized apparatuses in company with larger diameter wafers for the following reasons: deflection of a polishing table and work holding plates by weights thereof and polishing pressure, and thermal deformation by heat generation in polishing action; and in addition thereto, deformation and displacement of the polishing table and the work holding plates caused by various kinds of mechanical deflections in rotation thereof.

In order to cope with such problems, various kinds of ingenious contrivances have been practiced about a structure and materials, and operating conditions of the polishing apparatus and other polishing conditions. For example, some of contrivances on the structure are as follows: (a) in order to prevent thermal deformation of a polishing table, as shown in FIG. 20, a separate lower table 23 on which multiple recesses 21 for circulating a cooling water H are formed is provided on a lower surface of an upper table 12 on an upper surface of which the polishing cloth 16 is adhered; further, ribs are provided on a lower surface of a polishing table to prevent deformation due to polishing pressure; and still further in order to effectively suppress thermal deformation, contrivances have been piled up about a structure of a polishing table and arrangement of flow paths of cooling water, as shown in JP-A-95-52034 and JP-A-98-296619.

In a prior art polishing table shown in FIG. 20, however, there is adopted a structure in which an upper table 12 made of SUS410 and a lower table 23 made of cast iron such as FC-30 provided with flow paths for cooling water are coupled to each other by fastening them with clamping members 11 or the like, and a temperature difference between the upper and lower surfaces of the upper table arising in the course of a prior art polishing operation is generally 3° C. or higher and, in higher cases, 5° C. or higher; therefore, a difference in height (deformation) at a highest or lowest point occurs inconveniently in places on the upper surface of the upper table amounting to 100 $\mu$m or more relative to the reference plane, namely the upper surface of the upper table with no temperature difference between the upper and lower surfaces thereof.

Furthermore, the following proposals have been made: (b) that a material with a low thermal expansion coefficient ($8\times10^{-6}$/° C.) is used as a material of a polishing table (WO94/13847), that a polishing table is of a one-piece structure made of ceramics in which a flow path for circulating cooling water is formed throughout almost all of the interior (JUM-A-84-151655), and the like techniques; and in addition, (c) that a temperature control fluid is likewise circulated in a work holding plate for the purpose of improving temperature uniformity across a wafer holding surface of the wafer holding plate (JP-A-97-29591).

Moreover, in order to suppress a temperature rise of a wafer and a polishing cloth due to heat generation accompanying polishing action, the following procedures have been performed: in addition to the cooling of the work holding plate and the polishing table described above, a cooling function is also given to a polishing agent solution (in usual case, a weak alkaline aqueous solution mixed with colloidal silica is used.) supplied directly onto a polishing action surface, an amount of the polishing agent solution exceeding a supply amount necessary for polishing action in a pure sense is supplied onto the polishing cloth, and the polishing agent solution discharged from a polishing site is recycled in order to reduce the cost.

In the construction of the prior art polishing apparatus and a cooling method as described above, a temperature on a polishing cloth surface during polishing gradually rises from the start of polishing and a value of the temperature at a portion where the polishing cloth is put in contact with a to-be-polished surface of the wafer rises usually to 10° C. or higher and a temperature at a corresponding upper surface portion of the polishing plate direct under the portion of the polishing cloth in the contact also rises by 3° C. or more.

On the other hand, changes in temperature on the lower surface of the polishing plate are restricted to 1° C. or less by virtue of an effect of suppression of a temperature rise by cooling water. Therefore, a temperature difference of at least 3° C. or more arises not only between the upper and lower surfaces of the polishing table, but also between a high temperature portion and a low temperature portion on the upper surface of the polishing table, which causes a portion of the upper surface of the polishing table with thermal deformation/displacement of 100 $\mu$m or more in a direction normal to the upper surface of the polishing table in comparison with that when no temperature difference exists.

Furthermore, a work holding plate has become larger in size in response to transition in diameter of a silicon wafer toward a larger value. For example, in case of a work holding plate for use in polishing of 8 inch wafers, a diameter of the work holding plate assumes about 600 mm and a weight thereof also increases as the diameter increases.

Accordingly, not only thermal deformation of a work holding plate caused by heat generation at a polishing surface but also deformation caused by a weight of the work holding plate are problematic; therefore, various trials have been performed in order to suppress such deformation: to increase in thickness of a work holding plate or to decrease deformation by use of a material whose modulus of longitudinal elasticity is large, such as ceramics (silicon carbide and alumina).

Moreover, in a prior art batch polishing, as shown in FIG. 21, for example, a method was adopted in which a to-be-polished wafer W is adhered on a work adhesion surface 20*a* of the work holding plate 20 with an adhesive 22 applied therebetween.

In this case, it is important that no air bubble is left behind in a adhesive 22 layer and at interfaces between the wafer or the work holding plate 20 and the adhesive 22. For this purpose, a adhering process goes in the following way: as shown in FIG. 21, an air bag 27 expanding so as to be convex downward and provided on a lower surface of a pressure head 25 is pushed onto an upper surface (a surface opposed to the to-be-adhered surface) of the wafer W by the action of a pressure cylinder 26 and a contact surface under pressure of the air bag with the upper surface is increased by the push from the central portion of the to-be-adhered surface of the wafer sequentially part by part toward the periphery thereof such that air in the adhesive and at the adhesion interfaces are driven out and beyond the outer edge of the periphery of the wafer. However, while air in a boundary layer between an adhesive and each of the wafer W and the work holding plate is expelled by such a push-out method with a wafer pressure member 24, a thickness of the adhesive layer 22, on the other hand, is apt to be thinner at a central portion of the wafer W, which causes an inconvenience that the wafer W is fixed in a distorted state.

While, in the prior art, natural rosin, synthetic rosin ester, beeswax, phenol resin and so on were employed as adhesives for use in adhesion of a wafer taking into consideration various factors such as dissolution resistance to a polishing agent solution, a non-lubricating property, a change in characteristics due to a temperature rise of the adhesive through a temperature rise due to polishing heat generation, adhering action by such adhesives is mainly dependent on a physical adhesion mechanism, which goes like this: After an adhesive dissolved in a solvent is applied on an adhesion surface of the wafer holding plate, the solvent is evaporated off, and then, a wafer is pushed onto the work holding plate at a prescribed pressure while keeping the adhesive in a softened state under heat application and thereafter, the adhesive is solidified by cooling to a normal temperature to complete the adhesion.

In such an adhering process, it is necessary to heat a wafer and a work holding plate at a temperature, for example, ranging from 50 to 100° C. and improvement on processing precision is retarded by deformation of the wafer and the work holding plate caused by a thermal history in the heat treatment. In addition, there are required special apparatuses and facilities, and energy consumption for such heat treatment and others, which has also become problematic in an aspect of cost.

On the other hand, so-called normal temperature adhesives that have been available, which exert adhering action at normal temperature have not been able to be used in a practical aspect because of weak points such as low dissolution resistance to a polishing agent solution, difficulty in separating a wafer from a work holding plate and difficulty in removing the adhesive from a work holding plate.

Furthermore, in order to prevent air bubbles from being left behind in an adhesive at an adhesion site, the following processes have been practiced: a method in which a to-be-adhered surface of a wafer is pressed onto the work holding plate with an adhesive therebetween while holding the to-be-adhered surface of the wafer so as to be inclined to a work holding surface of the work holding plate and a contact surface is increased by the push from the one edge of the wafer sequentially part by part toward the edge opposite to the one edge thereof such that air in the adhesive between the to-be-adhered surface of the wafer and the work holding surface is expelled from one edge of the to-be-adhered surface of the wafer toward the edge opposite to the one edge thereof, a method in which as shown in FIG. 21, an elastic member having a convex front shape(air bag) 27 is pressed onto the upper surface of the wafer W placed on the work holding plate 20 while increasing a contact area part by part sequentially from the central portion of the wafer toward the periphery of the wafer to expel the air to the outside; and a method in which the whole of the work holding plate 20 or each wafer W is sealed by a holding surface of the work holding plate 20 so as to be air tight and the interior space closed by the sealing is evacuated into a reduced pressure state, whereby no air is left behind.

In FIG. 22, 1 indicates a vacuum vessel; 2, bellows; 3, a cylinder for vertically shifting bellows; 4, an internal pressure adjusting pipe for bellows; 5, an internal pressure adjusting pipe for a vacuum vessel; 6, a vacuum suction pipe; 20, a work holding plate; and W, a wafer.

A fault that a thickness of an adhesive layer becomes non-uniform (equal to or more than 0.5 $\mu$m) is problematic in a method shown in FIG. 21 in which a to-be-adhered surface of a wafer is pushed to increase a contact area sequentially part by part from a portion of the to-be-adhered surface thereof, while problems arise such as that a special apparatus and special tools are required and a process is complex, and in addition that dust is generated from the apparatus and tools in a method shown in FIG. 22 in which a wafer or all of a work holding plate is placed in a vacuum state to complete adhesion.

DISCLOSURE OF THE INVENTION

In polishing finish of a wafer, as described above, there have been various factors that are obstacles against achievement of high precision finish thereof meeting higher level of device fabrication techniques now and in the future, not only in connection with deformation by various causes of a polishing apparatus: particularly a work holding plate directly holding a wafer, which is a to-be-processed work, and a polishing table on which a polishing cloth in contact with the wafer is adhered and variations in operation of the apparatus, but also in connection with an adhering method for pasting the wafer on the work holding plate.

The inventors have drastically studied on factors which work as obstacles against high precision processing in connection with not only construction, configuration and materials of a polishing apparatus but also in connection with all the process relating to wafer polishing including an adhering apparatus for a wafer and an adhering method therefor in order to efficiently produce a high precision polishing finish wafer, especially, a high precision wafer of a large diameter of 300 mm or more, in a stable manner through trial manufacture of an apparatus and empirical, comparative studies on a system configuration and operating conditions, with the result that a success has been achieved that a high precision polished wafer can be stably produced by integrally enhancing functions and performance of not only the adhering method for a wafer but also the polishing apparatus and besides, improving an operating method therefor fundamentally.

Among achievements of the above described studies, it has been found that deformation during a polishing operation occurring in a polishing table, on which a polishing cloth is adhered and which is a base for holding a shape of a polishing cloth, or in a work holding plate, which is a base for holding a wafer, is a great obstacle against polishing a high precision (high flatness) wafer and further that it is effective that polishing is performed such that an amount of deformation of the polishing table in a direction normal to an upper surface thereof or an amount of deformation of the work holding plate in a direction normal to a work holding surface thereof is kept to be 100 $\mu$m or less, preferably 30 $\mu$m or less, more preferably 10 $\mu$m or less.

It is accordingly an object of the present invention to provide a polishing apparatus and a polishing method both capable of performing polishing a work (such as a wafer) with high efficiency and high precision, a novel work holding plate effectively holding a work and an adhering method for a wafer capable of adhering the work on the work holding plate with high precision.

In order to solve the above described problems, a first aspect of a polishing apparatus of the present invention comprises: a polishing table; and a work holding plate, wherein a work held on the work holding plate is polished supplying a polishing agent solution, and in polishing action, an amount of deformation of the polishing table in a direction normal to an upper surface thereof and/or an amount of deformation of the work holding plate in a direction normal to a work holding surface thereof is restricted to 100 $\mu$m or less. The amount of deformation is preferably restricted to 30 $\mu$m or less.

A second aspect of a polishing apparatus of the present invention comprises: a polishing table; and a work holding plate, wherein a work held on the work holding plate is polished supplying a polishing agent solution, and the polishing table is formed in one-piece by casting, a structure of the polishing table is such that a plurality of recesses and/or a plurality of ribs are provided on a rear surface thereof, a flow path for a temperature adjusting fluid is formed inside of the polishing table, and portions in each of which the flow path is not formed act as an internal rib structure.

That is, the polishing apparatus of the present invention has a great feature of the one-piece polishing table which includes a flow path for a temperature adjusting fluid and recesses and/or ribs on a rear surface thereof and also includes the internal rib structure inside thereof, and thereby can enjoy the following advantages:

(1) Comparing with the prior art structure in which an upper table 12 and a lower table 13 illustrated in FIGS. 16 and 17 are fastened with clamping members 11, and a table of a double layer structure disclosed in JP-A-98-296619, the structure of the present invention is higher in strength, and hence can suppress thermal deformation and deformation caused by a pressure of cooling water into a lower level.

(2) It is, therefore, possible to make the polishing table thinner in the total thickness and lighter in the weight.

(3) There arises no secular change such as looseness of the clamping members.

(4) Due to no requirement for clamping sites, it is possible to distribute more widely a flow path for a cooling fluid (for temperature adjustment), enlarge a heat transfer area, reduce a pressure loss along the flow path, and then flow a larger amount of the fluid, thereby a cooling effect being improved by a great margin.

(5) Due to the thinner structure of the polishing table, distances between the surface of the table and a cooling water flow path can be made shorter, thereby a cooling effect being improved more correspondingly to reduction in the distances. Furthermore, in the above structure of the polishing table, displacement of an upper surface of the polishing table relative to a reference plane can be restricted to 100 $\mu$m or less at any point thereof, 30 $\mu$m or less by further adopting various kinds of structures of the present invention described below, and 10 $\mu$m or less in an ideal state.

It is preferable that a value of a thermal expansion coefficient of a material of the polishing table is $5\times10^{-6}$/° C. or less and corrosion resistance of the material is almost equal to that of stainless steel.

As the material of the above described polishing table, when invar, that is, stainless invar which is cast steel, for example, SLE-20A (made by Shinhokoku Steel Corp.) is used, a thermal expansion coefficient ($\alpha=2.5\times10^{-6}$/° C., wherein a is a linear expansion coefficient) is about ¼ as compared with SUS410 ($\alpha=1.03\times10^{-5}$/° C.); therefore, an amount of deformation of 30 $\mu$m or less can be realized. Furthermore, by thus fabricating a polishing table by casting cast steel, a one-piece structure can be achieved and the following precision processing finish of the polishing table becomes easy.

A third aspect of the present invention comprises: a polishing table; and a work holding plate, wherein a work held on the work holding plate is polished and temperature changes of the polishing table and/or temperature changes of the work holding plate in polishing action are controlled within a prescribed range by controlling a flow rate and/or a temperature of a temperature adjusting fluid.

Temperature changes are preferably within 3° C., more preferably within 2° C. at any position of the polishing table and/or the work holding plate in polishing action. In order to attain the purpose, as described above, the polishing table of the one-piece structure internally having the temperature adjusting fluid flow path is capable of very effectively increasing a contact area between the temperature adjusting fluid and the polishing table.

Furthermore, temperature changes at any position on a polishing surface of the polishing cloth in polishing action are preferably controlled to 10° C. or less, preferably to 5° C. or less by controlling a temperature and /or a flow rate of the polishing agent solution.

That is, under ordinary conditions for achieving a prescribed polishing speed (0.5 to 1.0 $\mu$m/min) by a prior art polishing apparatus, a temperature on a surface of a polishing cloth rises by heat generation accompanying polishing action and the temperature changes in excess of 10° C., especially at a site at which the polishing cloth is rubbed by the to-be-polished surface of the wafer; in order to realize the fundamental concept of the present invention that temperature changes (variations) on the polishing table and/or the work holding plate during polishing action are restricted to within 3° C., and an amount of deformation thereof, especially that in a direction normal to an upper surface of the polishing table or a work holding surface of the work holding plate is kept to be 100 μm or less, preferably 30 μm or less, more preferably 10 μm or less, it is important that temperature changes are controlled to 10° C. or less, preferably 5° C. or less on the surface of the polishing cloth and the wafer of heat generation sites in polishing.

In an actual practice of polishing, as described above, a polishing cloth most suited for the purpose and conditions of polishing is selected and adhered on a upper surface of a polishing table; applying a polishing agent solution between the polishing cloth and a to-be-polished surface of a wafer, the wafer and the polishing cloth are rubbed each other by a relative motion under a prescribed force pressing each other. A thermal conductivity of a polishing cloth generally shows a value lower than those of silicon and material of the polishing table or a work holding plate by one to three orders of magnitudes. Usually, a thickness of a polishing cloth ranges from 1 to 2 mm and a thermal resistance from the front surface of the polishing cloth to the upper surface of the polishing table through the polishing cloth is the greatest, compared with a distance from the upper surface of the polishing table to a temperature adjusting fluid flow path (10 to 50 mm) and a heat transfer distance from a work holding surface of the work holding plate to the temperature adjusting fluid flow path (10 to 30 mm); therefore, if temperature changes on the surface of the polishing cloth in polishing action are restricted to the lowest possible temperature in the range of 10° C. or less, preferably 5° C. or less, temperature changes at any points on an upper surface of the polishing table or a work holding surface of the work holding plate in the polishing action can be restricted within 3° C. and preferably within 2° C.

At this time, it is important that cooling effects of the temperature adjusting fluid for the polishing table or the work holding plate are effectively exerted and also necessary that an cooling effect of the polishing agent solution is utilized positively.

In the above description, there are shown important requirements for realizing the fundamental concept of the present invention in connection with the polishing table, the work holding plate and the polishing agent solution, which are members directly associated with polishing action in the polishing apparatus and the operation (polishing) thereof; in order to effectively realize requirements, factors associated with a mechanism and control of the polishing apparatus are also very important. That is, it is necessary that mechanical variations accompanying driving (rotation) of the polishing table and precision of temperature control clear respective prescribed levels, which will be described below in a concrete manner.

Rotational unevenness of the polishing table is preferably restricted to 1% or less. The rotational unevenness of the polishing table means a proportion of variations in rotational speed of the polishing table in polishing action to a preset value thereof.

Surface displacement in rotation of a polishing surface of the polishing table is preferably restricted to 15 μm or less. The surface displacement in rotation of the polishing surface of the polishing table means displacement of the polishing surface of the polishing table in polishing action in an almost vertical direction at any position on the polishing surface.

Rotational displacement in rotation of a rotary shaft of the polishing plate is preferably restricted to 30 μm or less. The rotational displacement in rotation of the rotary shaft of the polishing plate means displacement in an almost horizontal direction at any position of the rotary shaft of the polishing table in polishing action. Note that requirements for the rotational unevenness of the polishing table, the surface displacement in rotation of the polishing surface of the polishing table and the rotational displacement of the rotary shaft of the polishing table can all be met by improving precision of a rotation system of the polishing table.

Furthermore, it is preferable that the work holding plate has recesses or a rib structure formed on a rear surface thereof By thus forming the recesses or the rib structure on the rear surface thereof like the polishing table, the work holding plate becomes lighter in weight while retaining its strength, and the recesses can be utilized as a path for a temperature adjusting fluid.

As described heretofore, in the polishing apparatus, the work holding plate not only supports a work physically, but also operates as an important factor to achieve the object of the present invention, and it is especially important to suppress the deformation thereof during polishing action. For this reason, it is preferable that as structural materials thereof, ceramics materials, among them alumina or silicon carbide (abbreviated as SiC) is used taking account of values of a mechanical strength and a thermal conductivity, workability, adhesiveness against a wafer and further, cost performance as well.

Moreover, as a method for holding a wafer on a work holding plate in addition to a method using an adhesive, a method of vacuum chucking a wafer on the work holding surface of the work holding plate is employed; therefore a structure is useful that a plurality of fine holes for vacuum chucking a work are opened in a region of the work holding plate where the wafer is adhered.

According to a first aspect of a polishing method of the present invention, there is provided a polishing method using a polishing apparatus with a polishing table and a work holding plate, wherein a work held on the work holding plate is polished, and in polishing action, an amount of deformation of the polishing table in a direction normal to an upper surface thereof and/or an amount of deformation of the work holding plate in a direction normal to a work holding surface thereof is restricted to 100 μm or less. It is more preferable that the amount of deformation is restricted to 30 μm or less.

According to a second aspect of a polishing method of the present invention, there is provided a polishing method using a polishing apparatus with a polishing table and a work holding plate, wherein a work held on the work holding plate is polished supplying a polishing agent solution, and when a to-be-polished surface of the work is polished by a polishing cloth adhered on the polishing table, temperature changes at any position on a polishing surface of the polishing cloth in polishing action are controlled to 10° C. or less. The temperature changes are preferably controlled to 5° C. or less.

According to a third aspect of a polishing method of the present invention, there is provided a polishing method using a polishing apparatus with a polishing table and a work holding plate, wherein a work held on the work holding plate is polished supplying a polishing agent solution, and temperature changes of the work in polishing operation are restricted to 10° C. or less. The temperature changes are preferably controlled to 5° C. or less.

It is an important embodiment of the present invention that temperature changes at any position on the polishing surface of the polishing cloth and/or temperature changes of a wafer in the polishing action are controlled to 10° C. or less, preferably to 5° C. or less by controlling a temperature and/or a flow rate of the polishing agent solution.

According to a fourth aspect of a polishing method of the present invention, there is provided a polishing method using a polishing apparatus with a polishing table and a work holding plate, wherein a plurality of works held on the work holding plate are polished, and the plurality of wafers are arranged and held on the work holding plate so as to satisfy a relationship expressed by the following formula (1) with errors within 2 mm:

$$R=\{(r+x)+\sin(\pi/N)(r+2y)\}/\sin(\pi/N) \quad (1)$$

(in the above formula (1), R: a diameter of a work holding plate (mm), r: a diameter of a wafer (mm). x: a distance between two adjacent wafers (mm), y: a distance between a wafer and a peripheral edge of the work holding plate (mm), N: the number of wafers per work holding plate and $\pi$ : the ratio of the circumference to its diameter. The distance x between two adjacent wafers is measured at the mutually closest points on the respective peripheries.)

In the case where a plurality of wafers are held on one work holding plate, a way of arranging the plurality of wafers on a holding surface is very important. That is, it is important that the held wafers are polished under the same condition microscopically as far as possible, in other words, that the greatest possible even polishing conditions including a polishing rate are fulfilled between wafers and within a to-be-polished surface of one wafer. For that purpose, important factors are temperature on the to-be-polished surface, a pressure onto the polishing cloth, a method for supplying the polishing agent solution, a relative movement distance between the wafer and the polishing cloth and others, and the above-described formula has been obtained by collectively and empirically studying such factors.

In the case where the above described formula (1) is applied to a wafer of 200 mm or more in diameter, that is, r is 200 mm or more, it is required that $5 \leqq N \leqq 7$, $5 \leqq x \leqq 20$ and $7 \leqq y \leqq 22$.

When a diameter (r) of a wafer increases to amount to 300 mm or more, a diameter (R) of a work holding plate increases as a matter of course. In company therewith, in order to suppress mechanical deformation, thermal deformation caused by temperature changes and others to the prescribed values or less, it is necessary that the thickness (d) of the work holding plate is increased with increase in the diameter (R), and as a result of various studies, in order to achieve the fundamental conception of the present invention that the amount of deformation of the work holding plate in a direction normal to the work holding surface thereof is restricted to 100 $\mu$m or less, preferably 30 $\mu$m or less, it is preferable that a thickness d of the work holding plate is determined such that $aR<d<bR$ (a=0.04 to 0.08 and b=0.10 to 0.12).

According to a fifth aspect of a polishing method of the present invention, there is provided a polishing method, wherein a silicon wafer is polished using the polishing apparatus of the present invention described above.

In the polishing method of the third aspect described above, the polishing operation is preferably performed in an environment where temperature changes are restricted within ±2° C. That is, in order to realize such high precision polishing, it is preferable that changes in an environmental temperature in a working space surrounding the polishing apparatus are restricted within ±2° C. of the prescribed temperature.

There are important a way to hold the work (wafer) on the work holding plate and a precision of a holding state thereof, that is not only flatness of the work holding surface but also evenness of a space between the holding surface and a to-be-adhered surface of the wafer. Particularly, in the case where a wafer is adhered and held on the work holding plate using an adhesive, attention should be focused on residual air bubbles in an adhesive layer between the wafer and the work holding plate, bow of the wafer in adhesion, and a thickness of the adhesive layer and its evenness.

Therefore, according to a method for adhering a work of the present invention, there is provided a method, wherein a work holding plate with a plurality of fine holes opened in an adhering region thereof for vacuum chucking a wafer is used and the wafer is adhered with an adhesive on the work holding plate by evacuating air through the plurality of fine holes from the rear side of the work holding plate. Such a construction of the method makes possible to eliminate the defects of the prior art method described above, reduce a thickness of the adhesive layer between the wafer and the work holding plate and improve evenness of the thickness thereof.

At this time, in order to facilitate the adhering operation, an adhering temperature is preferably kept at normal temperature (20 to 30° C.); in order to effectively perform the adhering, improve evenness of the thickness of the adhesive layer after the adhering (a deviation of the thickness is preferably 0.015 $\mu$m or less for high precision wafer processing), and reduce residual air bubbles in the adhesive layer as far as possible, a viscosity of the adhesive is preferably adjusted in the range of 1 mPa·s to 10 mPa·s during the period from application of the adhesive until prior to adhesion.

In order to effectively remove heat generated in polishing by a temperature adjusting fluid of the work holding plate through a wafer, it is necessary to reduce thermal resistance due to the adhesive layer interposing between the wafer and the work holding plate to the lowest possible level; in order to suppress variations in thickness of the adhesive layer caused by elastic deformation of the adhesive, it is also necessary to regulate a thickness of the adhesive layer to 0.5 $\mu$m or less, preferably 0.3 $\mu$m or less on the average, and a deviation of the thickness desirably to 0.015 $\mu$m or less.

A work holding plate of the present invention includes a plurality of suction holes for vacuum chucking a work in an adhering region on a work adhering surface of the work holding plate, each of the holes penetrating from the work adhesion surface of the work holding plate to a rear surface thereof.

By using the above described work holding plate of the present invention, the above described method for adhering a work of the present invention can be effectively performed.

Recesses or a rib structure is preferably provided on a rear surface of the above described work holding plate.

High precision wafer polishing finish becomes possible by polishing a silicon wafer which is adhered and held on a work holding plate by means of the above described method for adhering a work of the present invention. At this time, the use of the above described polishing apparatus is very effective for realizing high precision polishing finish implementing the fundamental concept of the present invention that in polishing action an amount of deformation of the polishing table in a direction normal to an upper surface thereof and/or an amount of deformation of the work holding plate in a direction normal to a work holding surface thereof is kept to be 100 $\mu$m or less, preferably 30 $\mu$m or less.

BEST MODE FOR CARRYING OUT THE INVENTION

Description will be given of embodiments of the present invention below on the basis of FIGS. 1 to 9 among the accompanying drawings. It is needless to say that various modifications or alterations of embodiments shown in the figures can be practiced without departing from the technical concept of the present invention.

Figure 1:
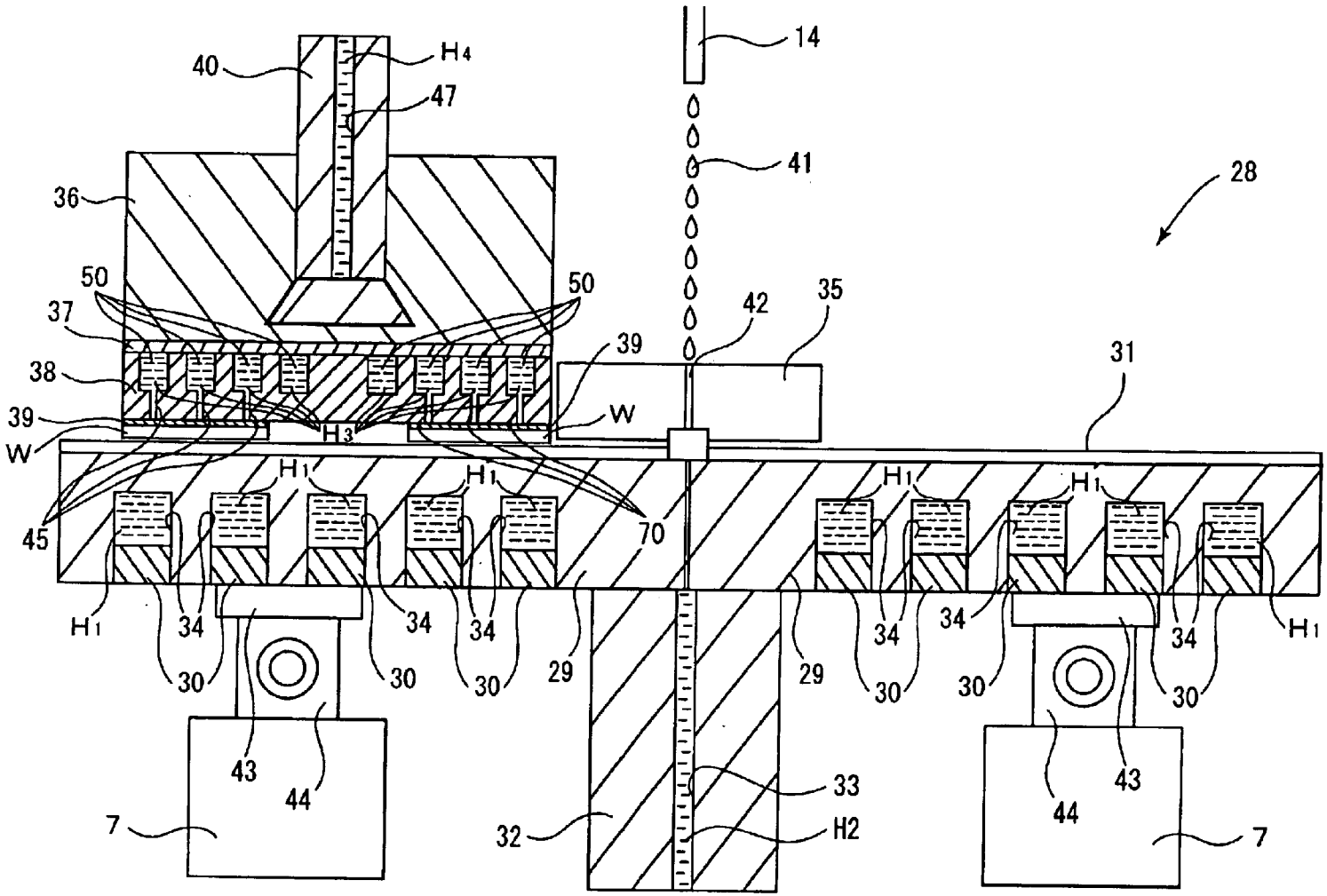
FIG. 1 is a partly omitted explanatory sectional view showing an embodiment of a polishing apparatus of the present invention.
Figure 2:
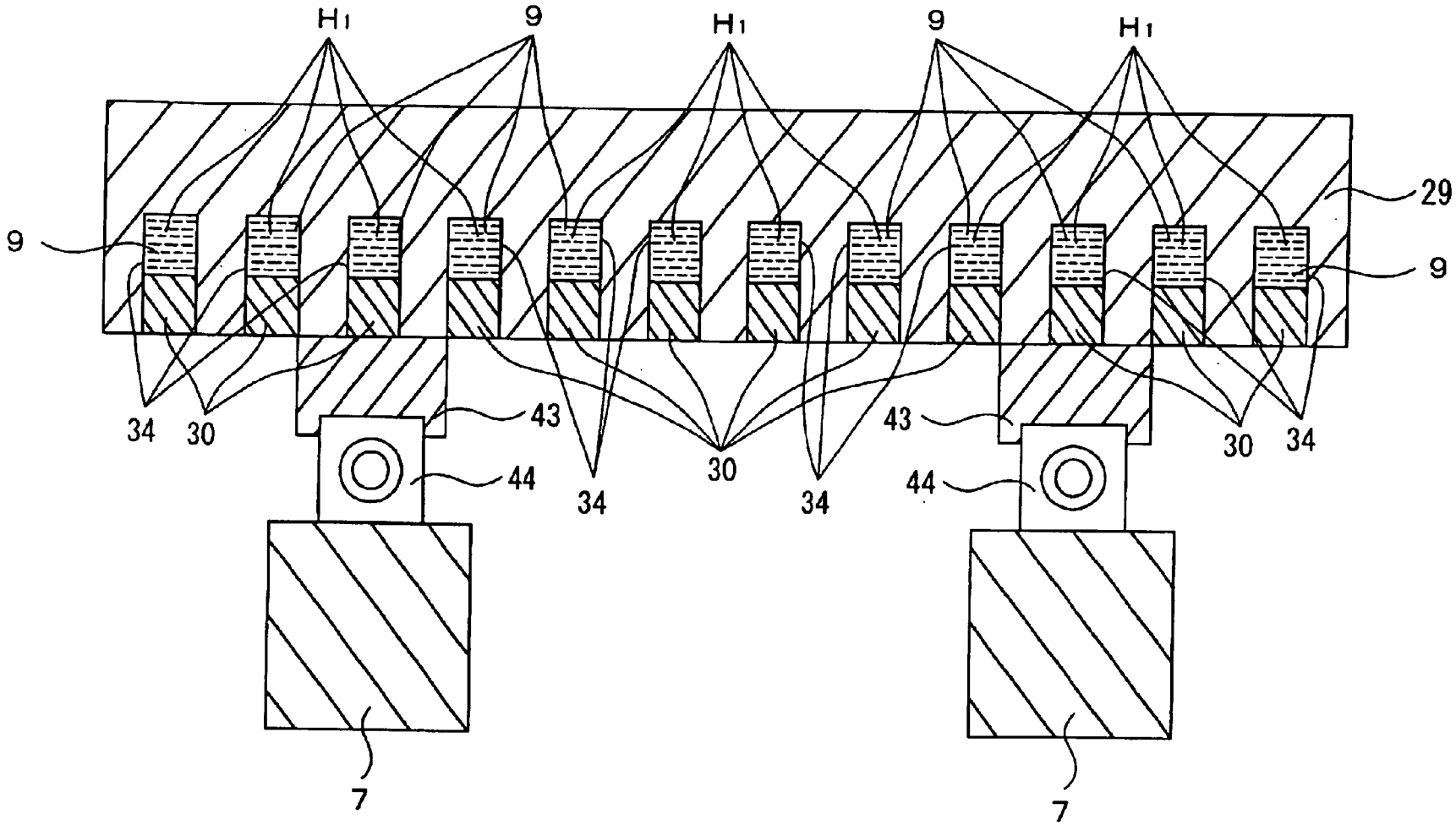
FIG. 2 is an explanatory sectional view showing an embodiment of a polishing table used in a polishing apparatus of the present invention.
Figure 3:
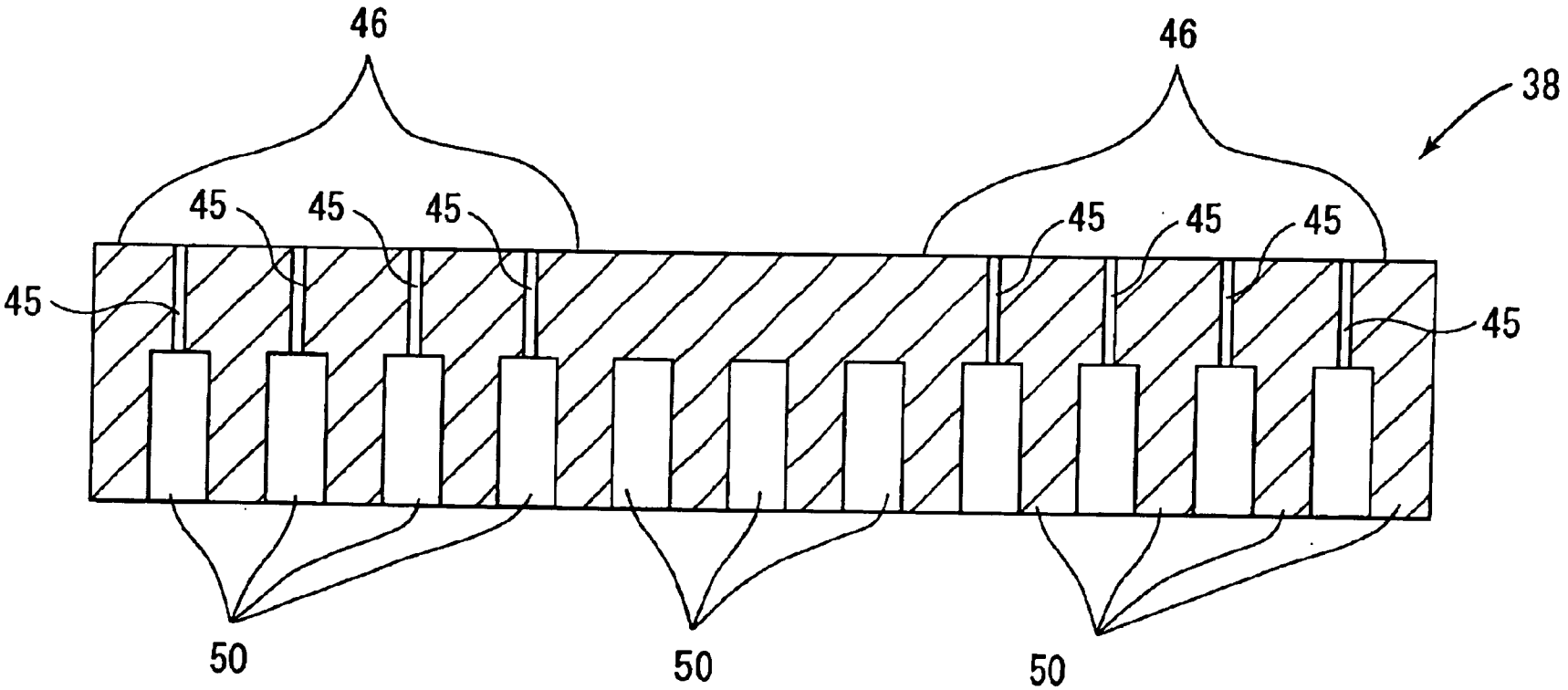
FIG. 3 is an explanatory sectional view showing an embodiment of a work holding plate used in a polishing apparatus of the present invention.
Figure 4:
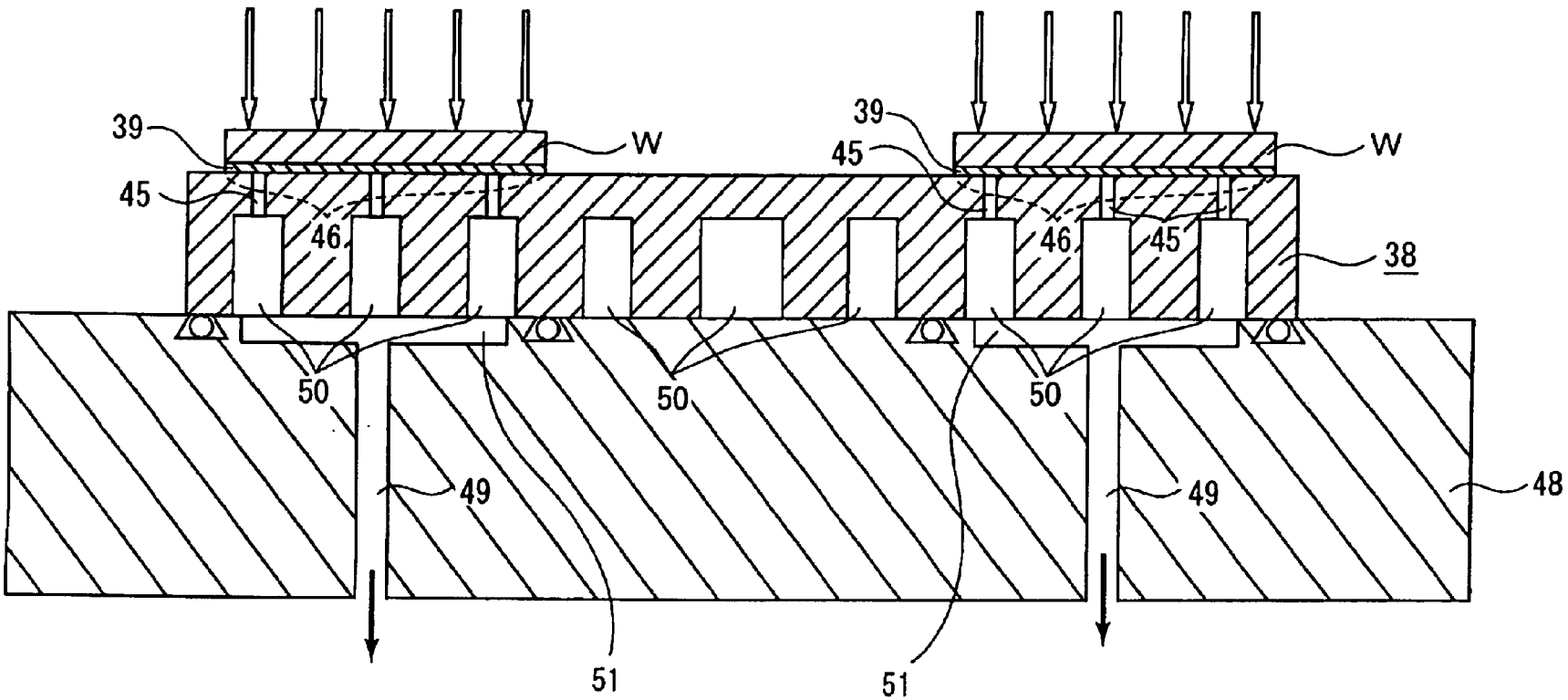
FIG. 4 is an explanatory view showing an embodiment of a method for adhering a work of the present invention.

FIG. 1 is a partly omitted explanatory sectional view showing an embodiment of a polishing apparatus of the present invention. FIG. 2 is an explanatory sectional view showing an embodiment of a polishing table used in a polishing apparatus of the present invention. FIG. 3 is an explanatory sectional view showing an embodiment of a work holding plate used in a polishing apparatus of the present invention. FIG. 4 is an explanatory view showing an embodiment of an adhering method for a work of the present invention.

In FIG. 1, a reference numeral 28 indicates a polishing apparatus according to the present invention, which has a polishing table 29. The polishing table 29 is fabricated as one-piece by casting as shown in FIG. 2, and provided with a number of recesses 34 on a rear surface of the polishing table 29. The recesses 34 are sealed with respective seal members 30 on the rear surface sides thereof to serve as a flow path for a temperature adjusting fluid, for example, cooling water $H_1$. The path for the cooling water $H_1$ is connected to a table cooling water heat exchanger $K_2$ described later and the cooling water $H_1$ can be heat exchanged in the heat exchanger $K_2$ to absorb heat generated at the polishing table 29 in polishing. A polishing cloth 31 is adhered on a polishing surface of the polishing table 29.

A reference numeral 32 indicates a rotary shaft provided in the central portion of a rear surface of the polishing table 29; 35, a center roller provided in the central portion of a front surface of the polishing table 29. A long hole 33 is bored longitudinally through the central portion of the rotary shaft 32, constitutes part of the flow path for a temperature adjusting fluid, for example, cooling water $H_2$, and the flow path of the cooling water $H_2$ is connected to a heat exchanger $K_4$ for table rotary shaft cooling water described later to absorb heat generated by mechanical friction in company with rotation of the table rotary shaft 32 in operation of the polishing apparatus. A reference numeral 7 indicates a frame which supports the polishing table 29 at the rear surface thereof with a support plate 43 and the bearing member 44.

A reference numeral 14 indicates a polishing agent solution supply pipe, through which a polishing agent solution 41 adjusted to a prescribed flow rate and a prescribed temperature is sent into a polishing agent solution guide hole 42 formed in the center roller 35 (guide rollers are not shown) by a polishing agent solution supply apparatus (not shown) and further the polishing agent solution 41 is supplied onto a polishing cloth 31 through the guide hole.

A reference numeral 36 indicates a top block and a work holding plate 38 is attached to a lower surface of the top block 36 with an elastic member 37 of rubber or the like inserted therebetween. A work, for example, a wafer W is adhered on an adhering surface of the work holding plate 38 with an adhesive 39. A reference numeral 40 indicates a rotary shaft vertically attached on the top block 36.

A reference numeral 47 is a long hole formed in the central portion of the rotary shaft 40, constitutes part of a flow path for a temperature adjusting fluid, for example, cooling water $H_4$ which is used for absorption of heat generated on the rotary shaft 40, and provided in each work holding plate. The flow path of the cooling water $H_4$ is connected to a heat exchanger $K_5$ for work holding plate rotary shaft cooling water described later and used for absorption of heat generated on the rotary shaft 40 in rotation of the work holding plate.

As shown in FIG. 3, a plurality of recesses 50 are bored on a rear surface of the work holding plate 38. A reference numeral 45 indicates suction holes for vacuum chucking, each of which penetrates from a bottom of a recess 50 located within a wafer adhering region 46 to the rear surface of the work holding plate 38. While each of the suction holes 45, as described later, is used for adhering a wafer W by vacuum suction when the wafer W is adhered in a wafer adhering region 46 of the work holding plate 38, the recesses 50 constitute part of a flow path of a temperature adjusting fluid, for example, cooling water $H_3$ in polishing of the wafer W. The flow path for the cooling water $H_3$ is connected to a heat exchanger $K_3$ for work holding plate cooling water described later, and the cooling water $H_3$ can be heat exchanged in the heat exchanger $K_3$ to absorb heat generated on the work holding plate 38, the cooling water $H_3$ being provided in each work holding plate.

Next, description will be given of a method for adhering a wafer W onto the above described work holding plate 38 on the basis of FIG. 4. In FIG. 4, a reference numeral 48 indicates an adhering base which is used when the wafer W is adhered in the wafer adhering region 46 of the work holding plate 38 with an adhesive 39. Recesses 51 each with a flat bottom is formed on an upper surface region of the adhering base 48 corresponding to the wafer adhesion region 46. Through holes 49 each penetrate from the bottom of a recess to a lower surface of the adhering base 48.

The through holes 49 are connected to an evacuation system such as including a vacuum pump and others to make the through holes 49, the recesses 51, and the recesses and the suction holes 45 of the work holding plate 38 in a state of a reduced pressure, so the wafers W can be sucked onto the respective wafer adhering regions 46 of the work holding plate 38. At this time, the adhesive 39 exists between each wafer W and a corresponding adhesion region 46; a to-be-adhered surface of the wafer W is vacuum sucked and thereby the wafer W is pressed uniformly by an atmospheric pressure; therefore, uniformity in thickness of the adhesive 39 is very good, and furthermore, air is sucked downward; therefore adhesion can be performed in a state where residual air in the adhesive layer is removed to almost zero.

As an adhesive used in adhering a wafer W to the work holding plate 38, there is preferably used an adhesive that can exert an adhering capability at temperature in the range of from 20° C. to 30° C. and shows a viscosity ranging from 1 mPa·s to 10 mPa·s. Furthermore, uniform adhesion is preferably performed such that a thickness of the adhesive of a work adhering portion is in the range of from 0.1 μm to 0.5 82 m on the average and a deviation of the thickness is 0.015 μm or less. As preferable adhesives, a polyol polyurethane adhesive is exemplified and it is preferable that such an adhesive is dissolved in an alcoholic solvent such as methanol, ethanol and others or an aqueous emulsion thereof. Besides, an isocyanate compound may be added to the adhesive as a curing agent.

Thus, a wafer W adhered on the work holding plate 38 in a state where almost no air is left behind in an adhesive layer and a thickness of the adhesive layer is highly uniform is mounted, as shown in FIG. 1, on a holding surface of the top block 36 and pressed onto the surface of the polishing cloth 31 on the polishing table 29, thereby the wafer W being polished.

In the course of polishing, generated heat on the polishing table 29 is absorbed by the cooling water $H_1$, generated heat on the rotary shaft 32 is absorbed by the cooling water $H_2$, generated heat on the work holding plate 38 is absorbed by the cooling water $H_3$ and generated heat on the rotary shaft 40 is absorbed by the cooling water $H_4$.

Thus, the cooling water $H_1$ to $H_4$ can be respectively supplied to each polishing element and rotation mechanism constituting the polishing apparatus 28 of the present invention; in polishing action, it is possible to keep an amount of deformation of the polishing table 29 in a direction normal to an upper surface thereof at 100 μm or less, preferably 30 μm or less, ideally 10 μm or less, and an amount of deformation of the work holding plate 38 in a direction normal to a work holding surface thereof at 100 μm or less, preferably 30 μm or less, ideally 10 μm or less.

Moreover, a value of a thermal expansion coefficient of a material of the polishing table is preferably $5\times10^{-6}$/° C. or less and as such material, there can be named so-called stainless invar of Fe—Co—Ni—Cr.

The polishing apparatus 28 of the present invention has a characteristic construction that temperature changes of the polishing table 29 and/or the work holding plate 38 in polishing action are controlled in a prescribed range by controlling a flow rate and/or a temperature of the temperature adjusting fluid. It is possible to achieve the characteristic construction by controlling flow rates and temperatures of the cooling water $H_1$ to $H_4$, respectively. That is, by controlling flow rates and temperatures of the cooling water $H_1$ to $H_4$, temperature changes of the polishing table 29 and/or the work holding surface of the work holding plate 38 in polishing action can be restricted within a prescribed range, for example, preferably within 3° C., more preferably within 2° C.

Figure 5:
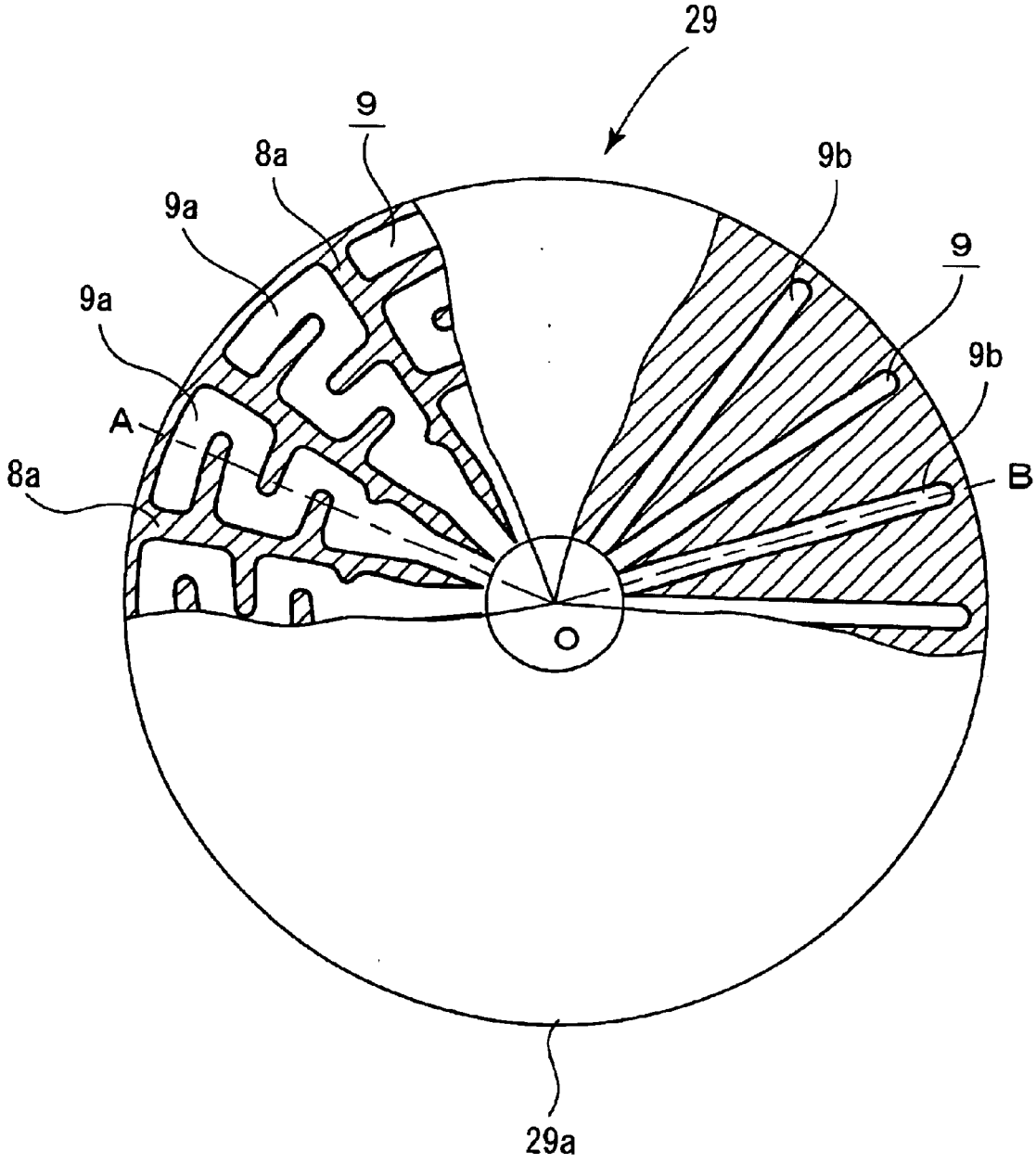
FIG. 5 is a partly cutaway top plan view showing a temperature adjusting fluid flow path of another embodiment of a polishing table of the present invention.
Figure 6:
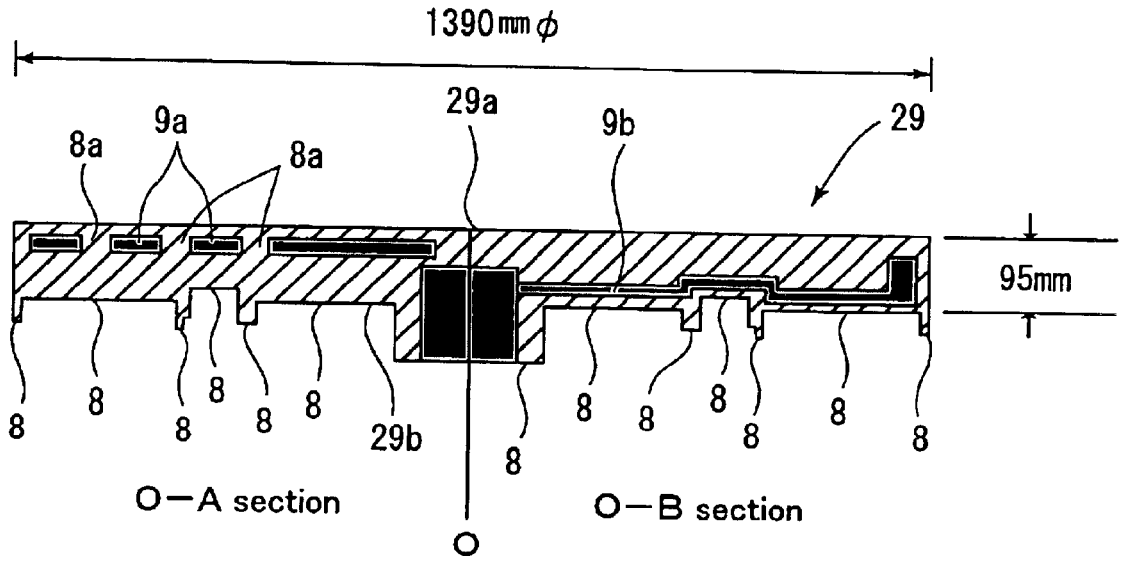
FIG. 6 is a longitudinal sectional view showing an upper fluid path portion and a lower fluid path portion of the polishing table of FIG. 5.
Figure 7:
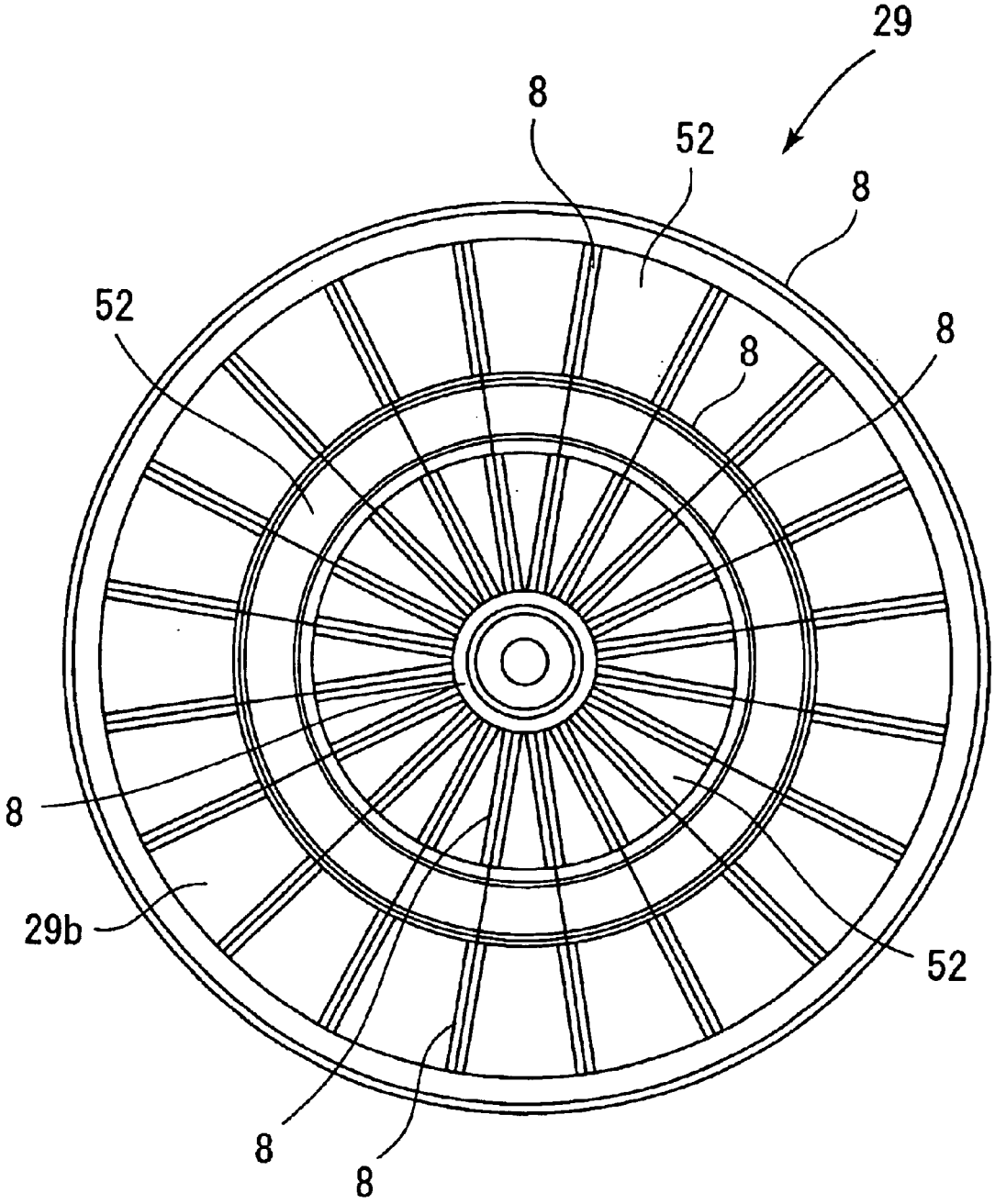
FIG. 7 is a rear view of the polishing table of FIG. 5.

While the polishing table 29 shown in FIGS. 1 and 2 is schematically shown for explanation of a concept of the present invention, description will be further given of a preferable concrete construction of the polishing table 29 on the basis of FIGS. 5 to 7. FIG. 5 is a partly cutaway top plan view showing a structure of an internal temperature adjusting fluid flow path of another embodiment of the polishing table. FIG. 6 is a longitudinal sectional view along lines O-A and O-B showing an upper fluid path portion and a lower fluid path portion, of the polishing table of FIG. 5. FIG. 7 is a rear view of the polishing table of FIG. 5.

The front surface 29*a* of the polishing plate 29 shown in FIGS. 5 to 7 is a plane and when in use the polishing cloth 31 is adhered thereon as shown in FIG. 1. A number of annular or radial ribs are provided as shown in FIGS. 6 and 7 on the rear surface 29*b* of the polishing table 29. With such many ribs 8 provided on the rear surface, the structure of the present invention may be higher in strength and light in weight.

Flow paths 9*a* and 9*b* for a temperature adjusting fluid, for example, cooling water or the like, are formed in the interior of the polishing plate 29 and among them, the upper flow paths 9*a* are designed such that each has a meandering structure, thereby efficient heat exchange being carried out.

The upper flow paths 9*a* communicate with lower flow paths 9*b* at peripheral portions of the polishing table and when a temperature adjusting fluid is supplied through the flow paths 9, the temperature adjusting fluid can flow in the following ways: a flow moves from the central portion of the upper flow paths 9*a* to the peripheral portions thereof, thereafter moves to the peripheral portions of the lower flow paths 9*b*, and then returns to the central portion thereof, or vice versa a flow moves from the central portion of the lower flow paths 9*b* to the peripheral portions thereof, thereafter moves to the peripheral portions of the upper flow paths 9*a*, and then returns to the central portion thereof.

Figure 8:
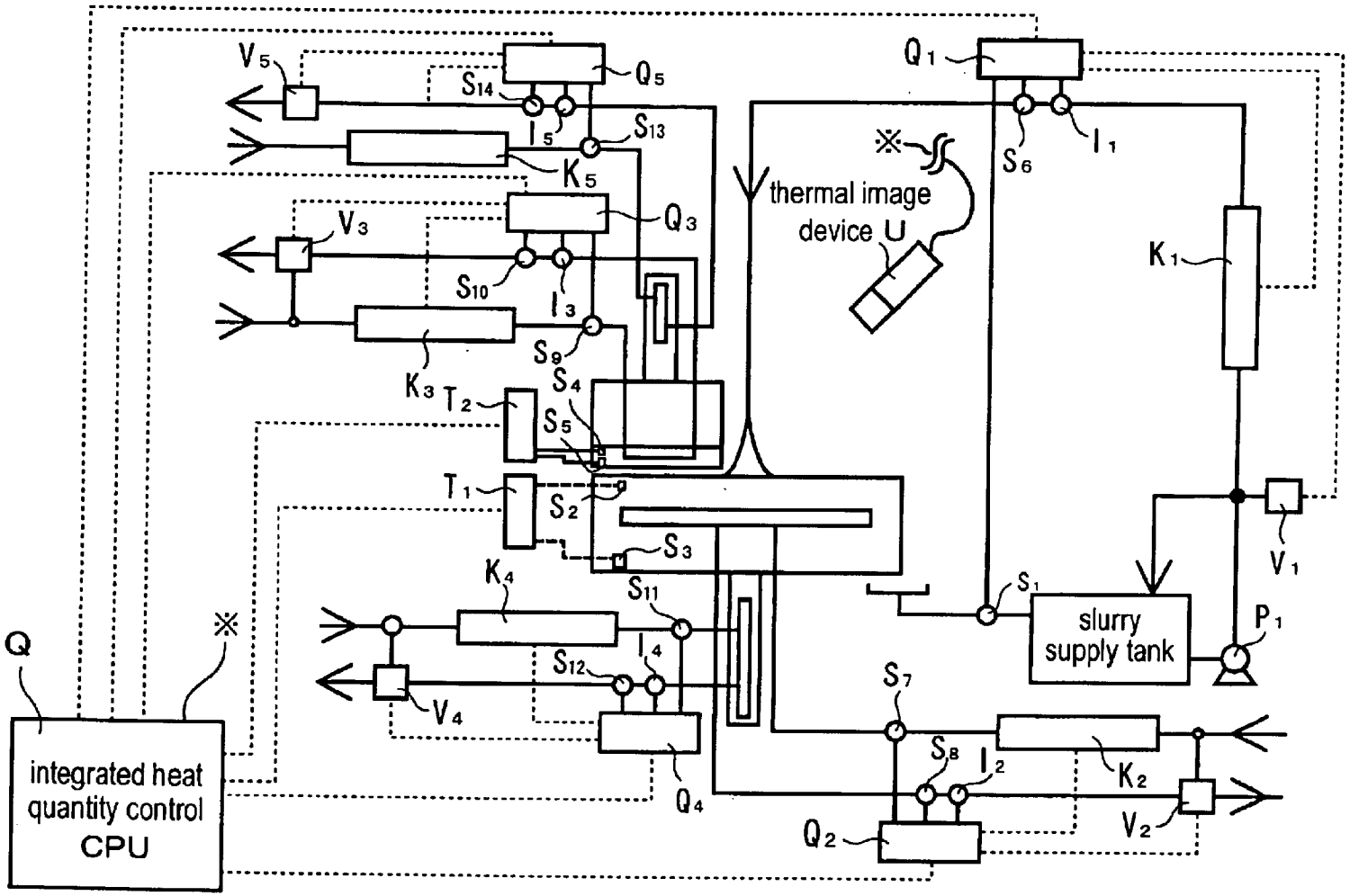
FIG. 8 is a block diagram showing a configuration of each apparatus in an integrated heat quantity control system in the present invention.
Figure 9:
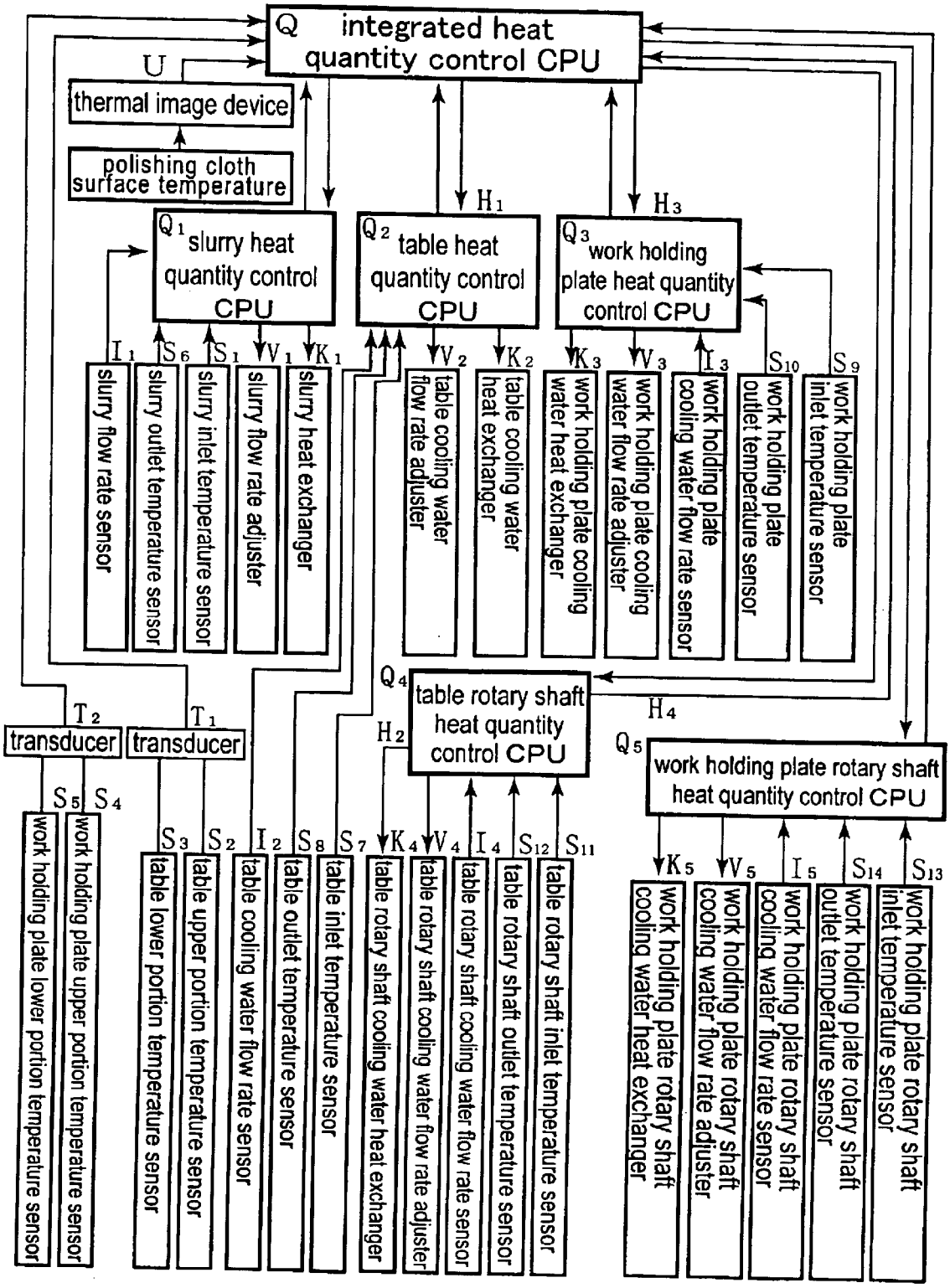
FIG. 9 is a flow chart showing control action of the integrated heat quantity control system in the present invention.

Subsequently, description will be given of an example of integrated heat quantity control, which is one of the features in a polishing apparatus and a polishing method of the present invention on the basis of FIGS. 8 and 9. FIG. 8 is a block diagram showing a configuration of each apparatus in an integrated heat quantity control system in the present invention. FIG. 9 is a flow chart showing control action of the integrated heat quantity control system in the present invention.

In FIGS. 8 and 9, Q indicates an integrated heat quantity control CPU, which is connected to a slurry heat quantity control CPU ($Q_1$), a table heat quantity control CPU ($Q_2$), a work holding plate heat quantity control CPU ($Q_3$), a transducer $T_1$ converting temperature signals from temperature sensors $S_2$ and $S_3$ embedded in the upper portion and lower portion of the table into electric signals, a transducer $T_2$ converting temperature signals from temperature sensors $S_4$ and $S_5$ embedded in the upper portion and lower portion of the work holding plate into electric signals, and a thermal image device U displaying a surface temperature of the polishing cloth, and issues various instructions to the slurry heat quantity control CPU ($Q_1$), the table heat quantity control CPU ($Q_2$) and the work holding plate heat quantity control CPU ($Q_3$) according to signals from each apparatus or device. Note that the transducers $T_1$ and $T_2$ preferably adopt a configuration in which temperature information signals such as currents, infrared rays, supersonic waves and others from the temperature sensors $S_2$, $S_3$, $S_4$ and $S_5$ are converted to electric signals.

The slurry heat quantity control CPU ($Q_1$) is connected to a slurry flow rate sensor $I_1$, a slurry outlet temperature sensor $S_6$, a slurry inlet temperature sensor $S_1$, a slurry flow rate adjuster $V_1$, and a slurry heat exchanger $K_1$, and issues necessary instructions to the slurry flow rate adjuster $V_1$ and the slurry heat exchanger $K_1$, respectively, on the basis of information from the slurry flow rate sensor $I_i$, the slurry outlet temperature sensor $S_6$ and the slurry inlet temperature sensor $S_1$.

The table heat quantity control CPU ($Q_2$) is connected to a table cooling water flow rate sensor $I_2$, a table outlet temperature sensor $S_8$, a table inlet temperature sensor $S_7$, a table cooling water flow rate adjuster $V_2$ and a table cooling water heat exchanger $K_2$, and issues necessary information to the table cooling water flow rate adjuster $V_2$ and the table cooling water heat exchanger $K_2$, respectively, on the basis of information from the table cooling water flow rate sensor $I_2$, a table outlet temperature sensor $S_8$ and a table inlet temperature sensor $S_7$.

The work holding plate heat quantity control CPU ($Q_3$) is provided to each of the work holding plates, and connected to a work holding plate cooling water flow rate sensor $I_3$, a work holding plate outlet temperature sensor $S_{10}$, a work holding plate inlet temperature sensor $S_9$, a work holding plate cooling water heat exchanger $K_3$ and a work holding plate cooling water flow rate adjuster $V_3$, and issues necessary information to the work holding plate cooling water heat exchanger $K_3$ and the work holding plate cooling water flow rate adjuster $V_3$, respectively, on the basis of information from the work holding plate cooling water flow rate sensor $I_3$, the work holding plate outlet temperature sensor $S_{10}$ and the work holding plate inlet temperature sensor $S_9$.

Moreover, at the same time, the integrated heat quantity control CPU (Q) is connected to a table rotary shaft heat quantity control CPU ($Q_4$) and each work holding plate rotary shaft heat quantity control CPU ($Q_5$); and configured such that there is removed heat quantity generated due to mechanical action in company with an operation of the polishing apparatus other than heat generation caused by polishing action and hence temperature changes in the polishing apparatus are suppressed to control to a prescribed temperature.

While it is preferable that temperature changes of each constituent of the polishing apparatus caused by various heat quantity generated in polishing action are individually suppressed in the respective constituents, it is also possible in response to the circumstances that the table rotary shaft heat quantity control system and the table heat quantity control system are controlled in a one-piece fashion, or alternatively the work holding plate rotary shaft heat quantity control system and the work holding plate heat quantity control system are controlled in a one-piece fashion for each work holding plate.

Besides, it is possible to use not only a liquid such as water but also gas with an external cooling system as a temperature adjusting fluid for the table rotary shaft heat quantity control system or the work holding plate rotary shaft heat quantity control system, as shown in the figures.

What is important at this time is to decrease an influence on temperature of the table and the work holding plate from heat generation caused by mechanical action other than heat generation directly caused by polishing action to the lowest possible level. Therefore, furthermore, various modifications or alterations can be performed with regard to temperature control of each of the constituents as far as realization of the fundamental concept of the present invention is assured; for example, without connecting the table rotary shaft heat quantity control CPU and the work holding plate rotary shaft heat quantity control CPU to the integrated heat quantity control CPU, heat quantity control (temperature control) for each system is performed independently with each CPU thereof.

While merits of the present invention will be described in further details on the basis of examples, the merits of the present invention are not limited thereto, but the invention may naturally cover embodiments other than the examples as far as those satisfy the fundamental concept of the present invention.

EXAMPLE 1

A batch polishing apparatus having a polishing table and a 4 shaft work holding plate rotation mechanism with a fundamental construction similar to the polishing apparatus shown in FIG. 1 was configured as follows:

1. Polishing Table: Invar (Shinhokoku Steel Corp., SLE-20A, Fe—Co—Ni—Cr) was used and prepared into a one-piece structure by casting and cooling water flow paths shown in FIGS. 5 and 6 are formed in the structure. Furthermore, as shown in FIG. 5 which depicts part of the flow paths 9 for a temperature adjusting fluid, in such a state as the upper surface portion of the table is partly cutaway, the table was designed such that the flow paths 9 are formed in a meandering manner, a fluid flow in the flow paths 9 are liable to enter a turbulent state and an average flow rate is increased to raise a heat transfer coefficient to the highest possible level, while portions in which the flow paths 9 are not formed functions as a rib structure 8*a* to maintain strength of the table.

2. Work Holding Plate: Alumina ceramics (made by KYOCERA CORP.) was used, as shown in FIG. 3, cooling water paths were formed on the rear surface portions corresponding to wafer adhering regions, and in the same regions a total of 85 fine holes (a diameter of 0.3±0.1 mm and 17 fine holes per wafer) for evacuation were formed, penetrating from the front surface of the work holding plate to the rear surface thereof.
3. Polishing Cloth: Suba 600 made by Rodel Co. was adhered on the polishing table.
4. Other Performance of Polishing Apparatus:
   a) unevenness in rotation of the polishing table: ±0.5%
   b) displacement in rotation of the polishing table surface: 15 μm, and
   c) displacement in rotation of the polishing table rotary shaft: 30 μm.
5. Construction of Temperature Adjusting System:

Like the integrated heat quantity control system shown in FIGS. 8 and 9, a temperature adjusting system was constructed such that flow rates and temperatures were adjusted in the respective following systems: a temperature adjusting fluid flow path system of the polishing table, a temperature adjusting fluid flow path system of the work holding plate, a polishing agent solution cycling system, a polishing table rotary shaft temperature adjusting fluid flow path system and a work holding plate rotary shaft temperature adjusting fluid flow path system for each of the work holding plates.

6. Outlines of Polishing Operation:

Each set of 5 silicon wafers each having a diameter 200 mm and a thickness 750 μm was adhered on each of 4 work holding plates each having a diameter 565 mm at room temperature (25° C.) using an adhesive (a methanol solution of a polyol polyurethane adhesive) with an adjusted viscosity of 5 mP·s at 25° C. such that the following formula is satisfied and centers of 5 wafers of each set are distributed equidistantly on a circle with a radius 175 mm from the center of each work holding plate. Coating of the adhesive was performed using a spin coating apparatus and adhesion of the wafers was performed using the apparatus shown in FIG. 4.

$$R=\{(r+x)+\sin(\pi/N)(r+2y)\}/\sin(\pi/N) \quad (1)$$

(in the above formula (1), R: a diameter of a work holding plate (mm), r: a diameter of a wafer (mm), x: a distance between two adjacent wafers (mm), y: a distance between a wafer and a peripheral edge of the work holding plate (mm), N: the number of wafers/work holding plate and π : the ratio of the circumference to its diameters.)

At this time, the wafers were adhered onto respective adhering portions while evacuating from a rear surface of a work holding plate using a vacuum evacuation apparatus and a work holding plate rear surface suction jig separately prepared, and the evacuation was continued at 200 mm Torr or less till the adhesion was completed (0.5 min). By performing such adhesion under evacuation, the average thickness of the adhesive layers at the adhering portions was in the range of from 0.20 to 0.22 μm per wafer and the deviation of the thickness of each wafer was 0.012 μm or less. The thickness of the adhesive layer was measured with an automatic film thickness mapping system F50 which is a film thickness measuring instrument made by Filmetrics Inc. The thickness measurement was performed after coating of an adhesive by spin coating. Since a viscosity of the adhesive increases by evaporation of the solvent after coating, it was confirmed that no adhesive was sucked into the fine holes for evacuation when evacuation was performed from the rear surface of the work holding plate using the apparatus shown in FIG. 4; therefore, it can be said that a thickness of the adhesive layer after completion of the adhesion is not essentially different from that of the adhesive layer after the coating thereof.

In such a fashion, 20 wafers were adhered on the work holding plates and polished in the following conditions:

(1) Polishing Table:
   Rotational Frequency: 30 rpm±0.5%,
   Cooling Water: 50 l/min or less, changeable
   Inlet Temperature: room temperature −1° C. (within ±0.5° C.), and
   Outlet Temperature: room temperature +1° C. or less.
(2) Work Holding Plate (free rotation):
   Load Weight Added: 250 g per $cm^2$ of a wafer surface,
   Cooling Water: 20 l/min or less (per work holding plate), changeable
   Inlet Temperature: room temperature −1° C. (±0.5° C.), and
   Outlet Temperature: room temperature +1° C. or less.
(3) Polishing Solution:
   $SiO_2$ content: 20 g/l, pH: 10.5 to 10.8, specific gravity: 1.02 to 1.03, and
   Supply Amount: 30 l/min.
(4) Polishing Time: 10 min
(5) Polishing Removal: 10 μm
(6) Room Temperature: 25±1° C.

Figure 10:
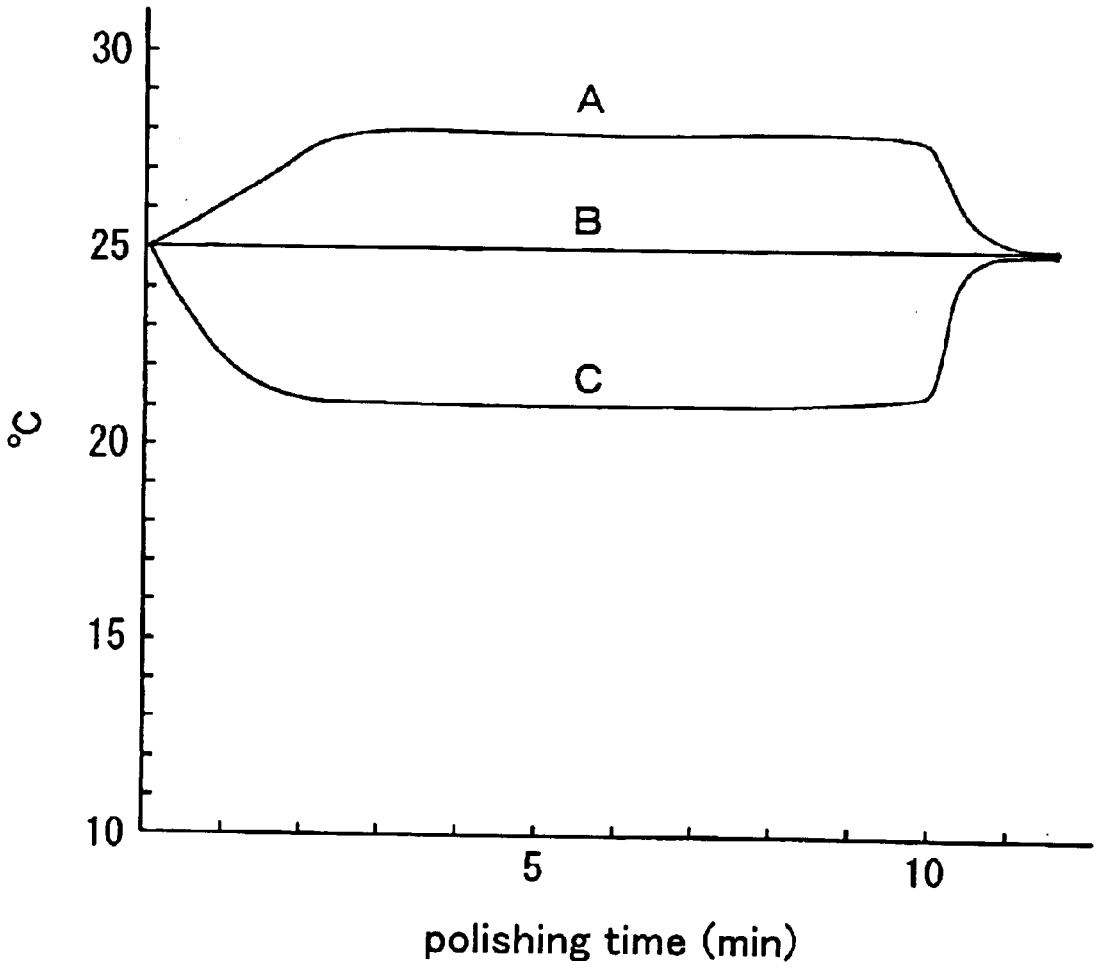
FIG. 10 is a graph showing relationships between a polishing time and a polishing cloth surface temperature, the polishing time and a polishing agent solution supply temperature, and the polishing time and a polishing agent solution return temperature in Example 1.

Temperature control of each cooling water system during the polishing was performed by the integrated heat quantity control system shown in FIGS. 8 and 9. Particularly, surface temperatures of exposed surfaces of the polishing cloth were measured using a thermal image sensor over a distance corresponding to a diameter of the work holding plate on a radius of the polishing table, and a supply temperature of the polishing agent solution (a slurry inlet temperature) was controlled such that an average of the measured surface temperatures was restricted within 3° C. of an environmental temperature (room temperature). The progress of the temperature control is shown in FIG. 10.

Figure 11:
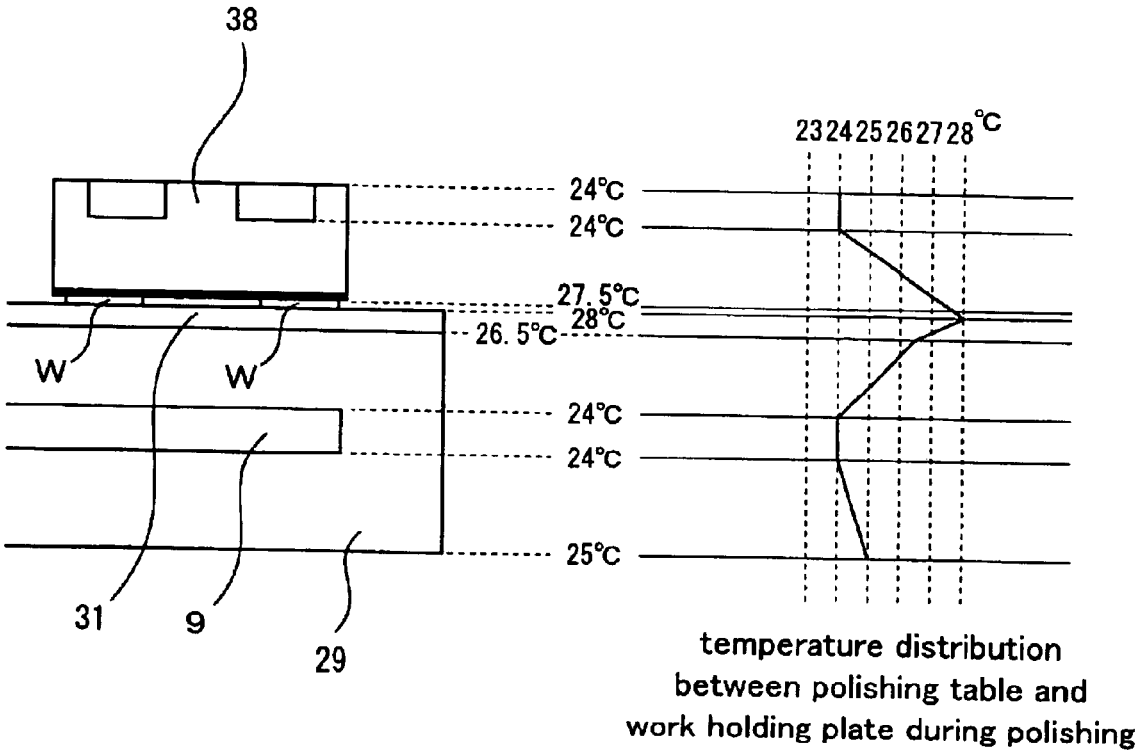
FIG. 11 is an analytical view of a temperature distribution in the range of from a rear surface of a work holding plate to a lower surface of a polishing table in Example 1.
Figure 23:
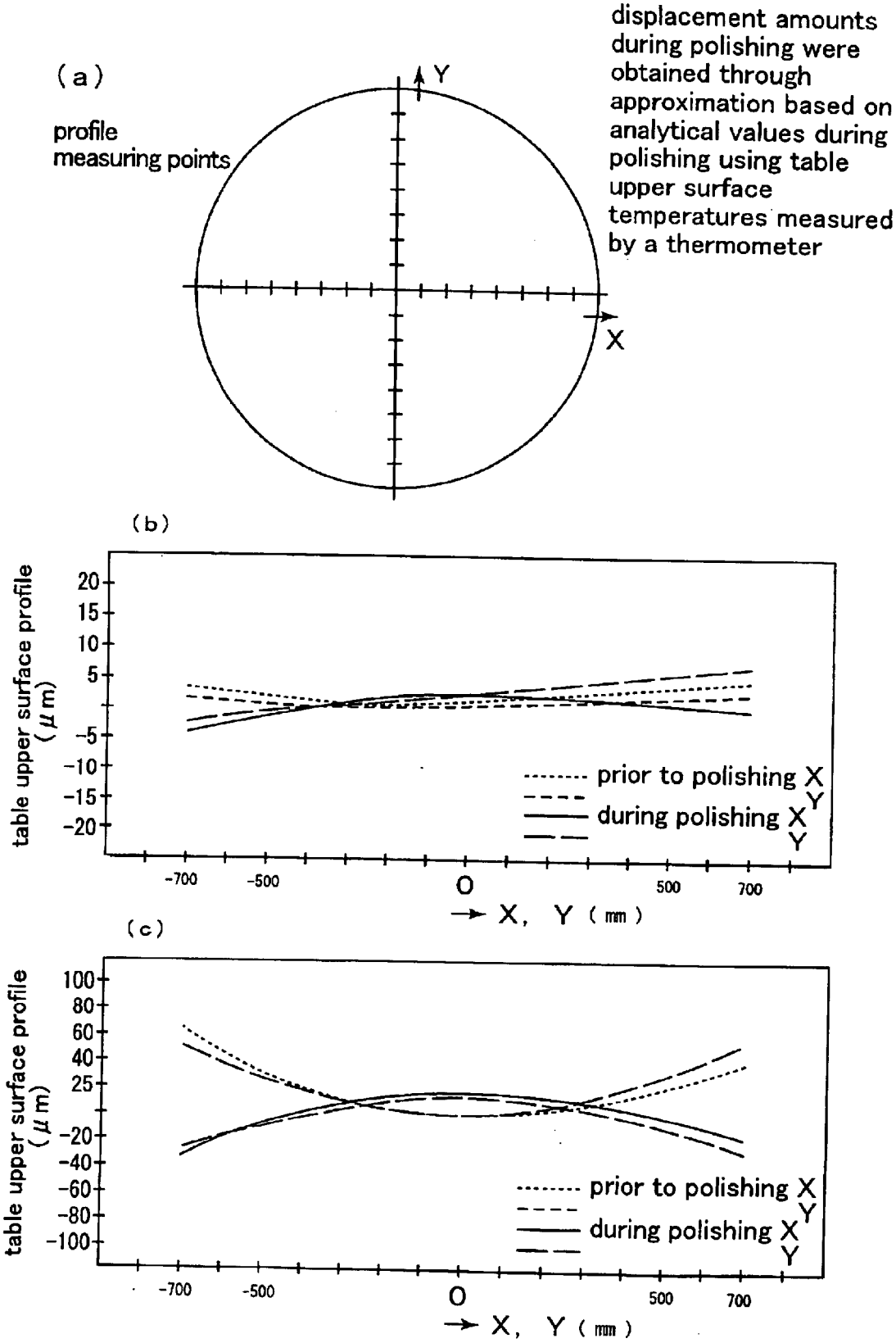
FIG. 23 is a graph showing displacement amounts of a polishing table in a direction normal thereto prior to polishing and during the polishing in Example 1 and Comparative Example 1, where (a) shows measuring points, (b) shows a displacement amount in Example 1 and (c) shows a displacement amount in Comparative Example 1.

Thus, the temperature on the surface of the polishing cloth during the polishing was controlled within 3° C. of room temperature (25° C.). An analytical result of a temperature distribution from the rear surface of the work holding plate through the lower surface of the polishing table in this case is shown in FIG. 11; a temperature of the work holding plate and a temperature of the polishing table are restricted within 3° C. of a temperature 25° C. prior to polishing action (an environmental temperature=room temperature). Furthermore, as shown in FIG. 23(*b*), it is understood that displacement of the upper surface of the table in a direction normal thereto at any point at this time is restricted to 10 μm or less as against the state prior to the polishing.

After the wafers has been polished in the above conditions, each wafer was separated from a corresponding polishing plate; thereafter, cleaning was applied on each wafer in the following way, that is, pure water→alkaline solution→$NH_4OH/H_2O_2$→pure water; and then finish precision was measured. Results are shown in Table 1 in comparison with results of Comparative Example 1.

TABLE 1

| Evaluation Items | Evaluation Details | Example 1 | Comparative Example 1 |
|---|---|---|---|
| GBIR | $\overline{X}$ | 1.0 μm | 1.5 μm |
| | σ | 0.3 μm | 0.47 μm |
| SFQRmax | Max | 2.0 μm | 3.0 μm |
| | $\overline{X}$ | 0.10 μm | 0.15 μm |
| | σ | 0.03 μm | 0.03 μm |
| SBIRmax | Max | 0.2 μm | 0.25 μm |
| | $\overline{X}$ | 0.16 μm | 0.31 μm |
| | σ | 0.03 μm | 0.06 μm |
| | Max | 0.25 μm | 0.5 μm |

Abbreviated symbols in Table 1 are described as follows:

GBIR: Global Back-side Ideal Range (=TTV) (a difference between the maximum and the minimum in thickness across the entire front surface of a wafer with a rear surface thereof as a reference plane.)

SBIR: Site Back-side Ideal Range (=LTV) (a difference between the maximum and the minimum in height in a given region (site) of a front surface of a wafer with a rear surface thereof as a reference plane.)

SFQR: Site Front least sQuare<site>Range (a difference between the maximum and the minimum in height in each site of a front surface of a wafer.)

Measuring conditions in Table 1 are as follows:

Measuring Instrument: ADE 9600E+(made by ADE corporation)

Wafer: 8-inch.diameter wafers

Pieces: 20 wafers per batch

Measuring Region: all the surface except a peripheral, annular region of a width of 2 mm from the edge of a wafer.

SFQRmax and SBIRmax are measured in areas obtained by segmenting all the measuring surface of a wafer into 25 mm×25 mm squares.

Comparative Example 1

Polishing and results thereof according to a prior art technique are shown as Comparative Example 1 in comparison with the results of Example 1.

Figure 14:
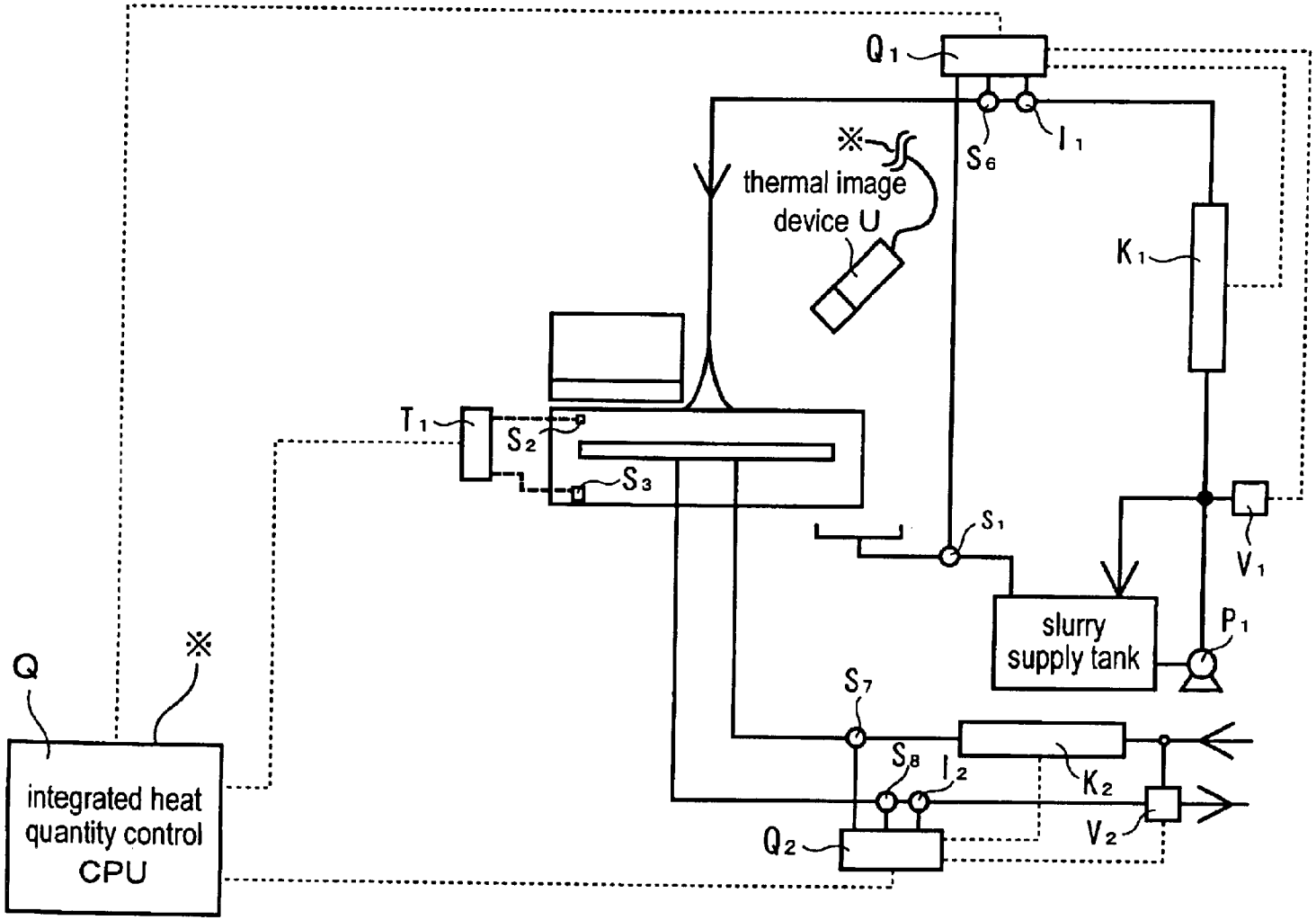
FIG. 14 is a block diagram showing a configuration of each apparatus in an integrated heat quantity control system used in Comparative Example 1.
Figure 15:
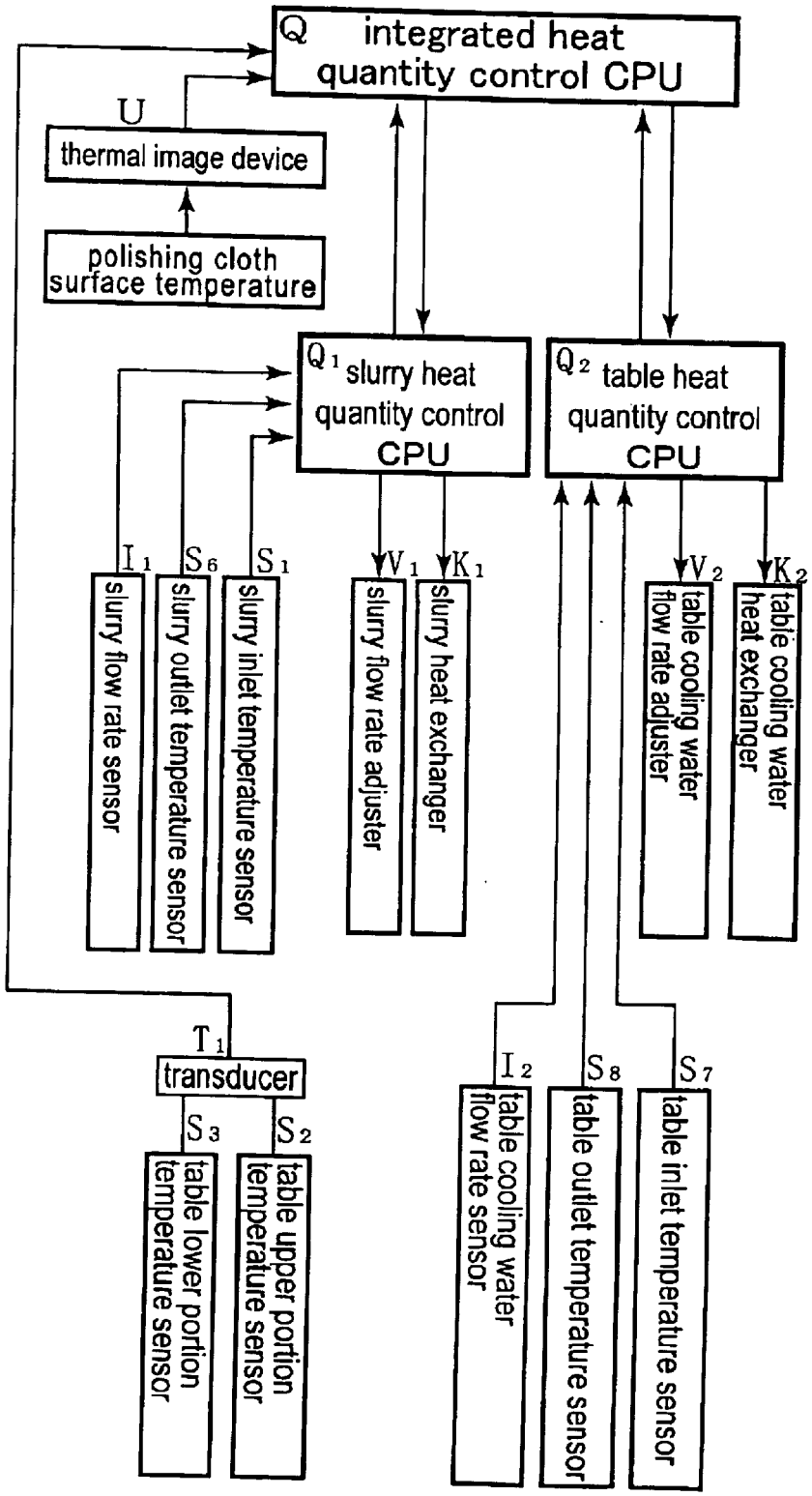
FIG. 15 is a flow chart showing control action of the integrated heat quantity control system in Comparative Example 1.
Figure 16:
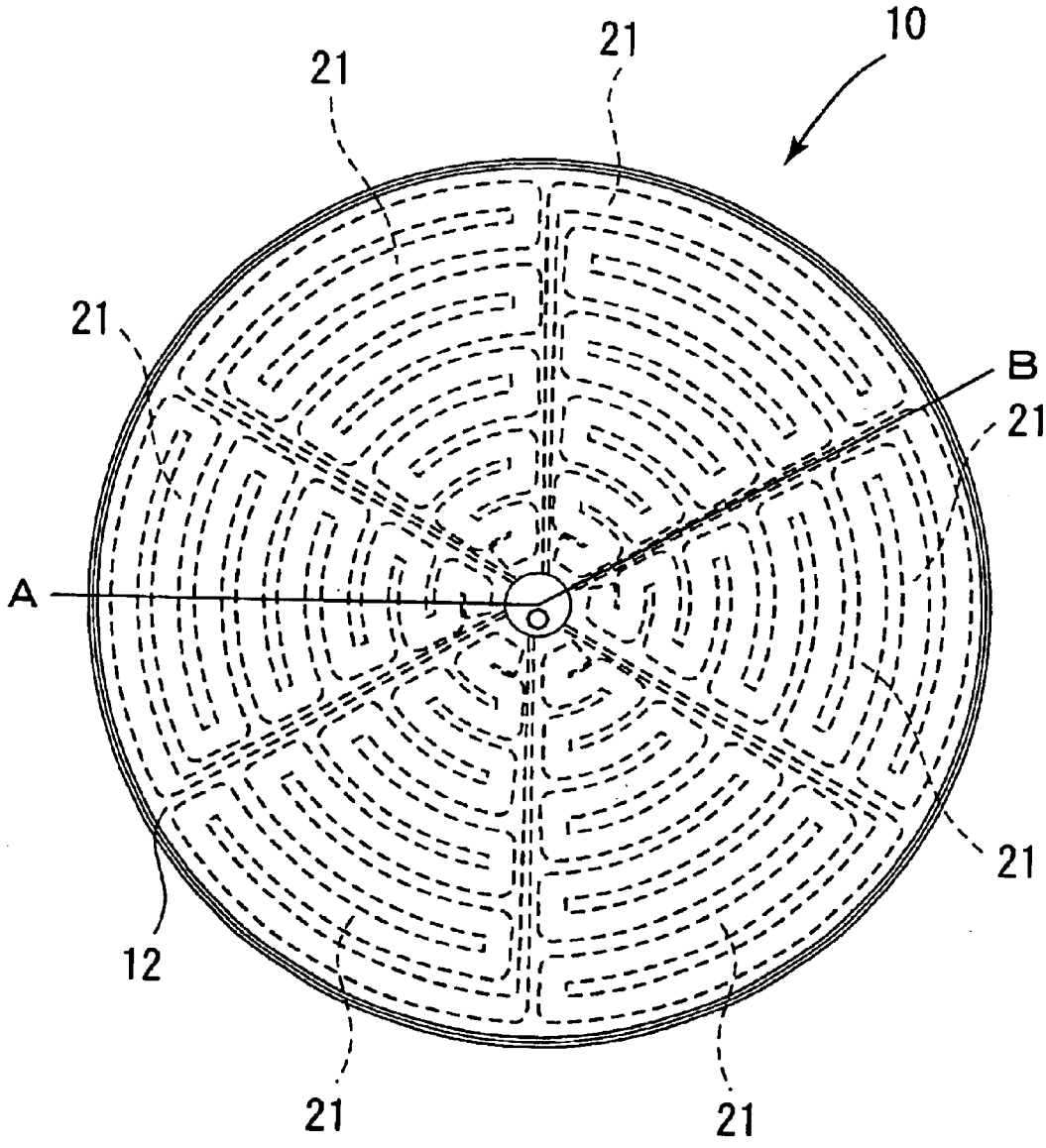
FIG. 16 is a top plan view of a polishing table used in Example 1.
Figure 17:
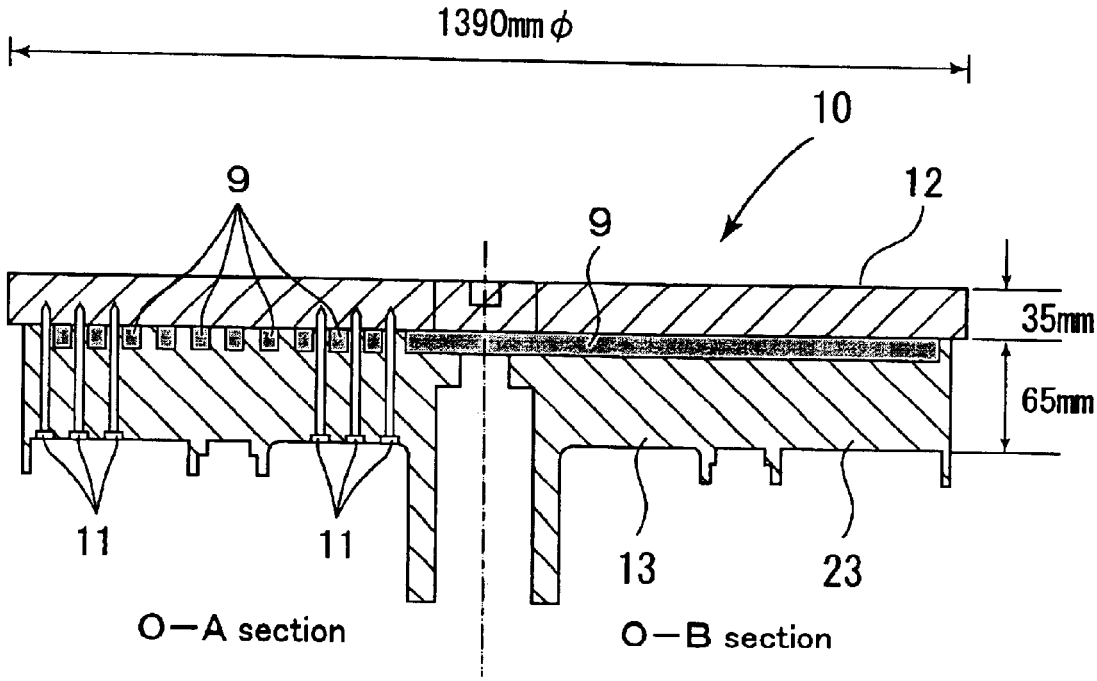
FIG. 17 is a longitudinal sectional view of FIG. 16.
Figure 18:
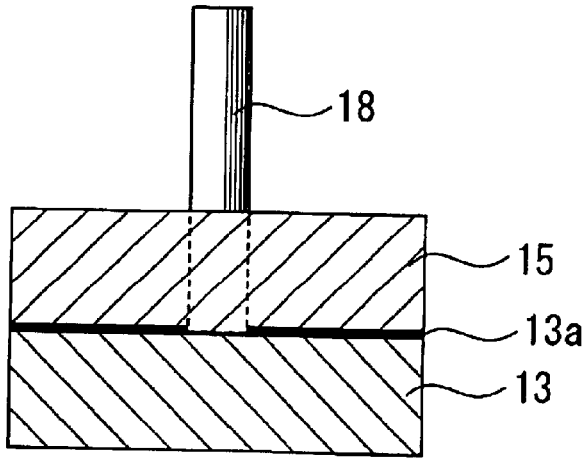
FIG. 18 is a longitudinal sectional view of a work holding plate used in Comparative Example 1.
Figure 19:
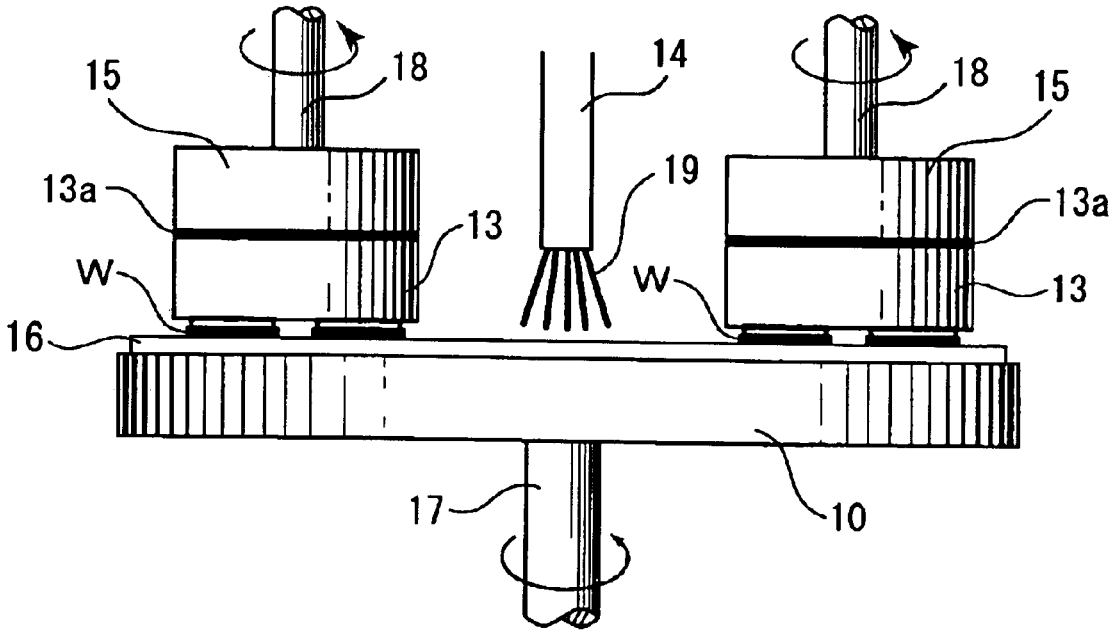
FIG. 19 is an explanatory side view showing an example of a prior art wafer polishing apparatus.
Figure 20:
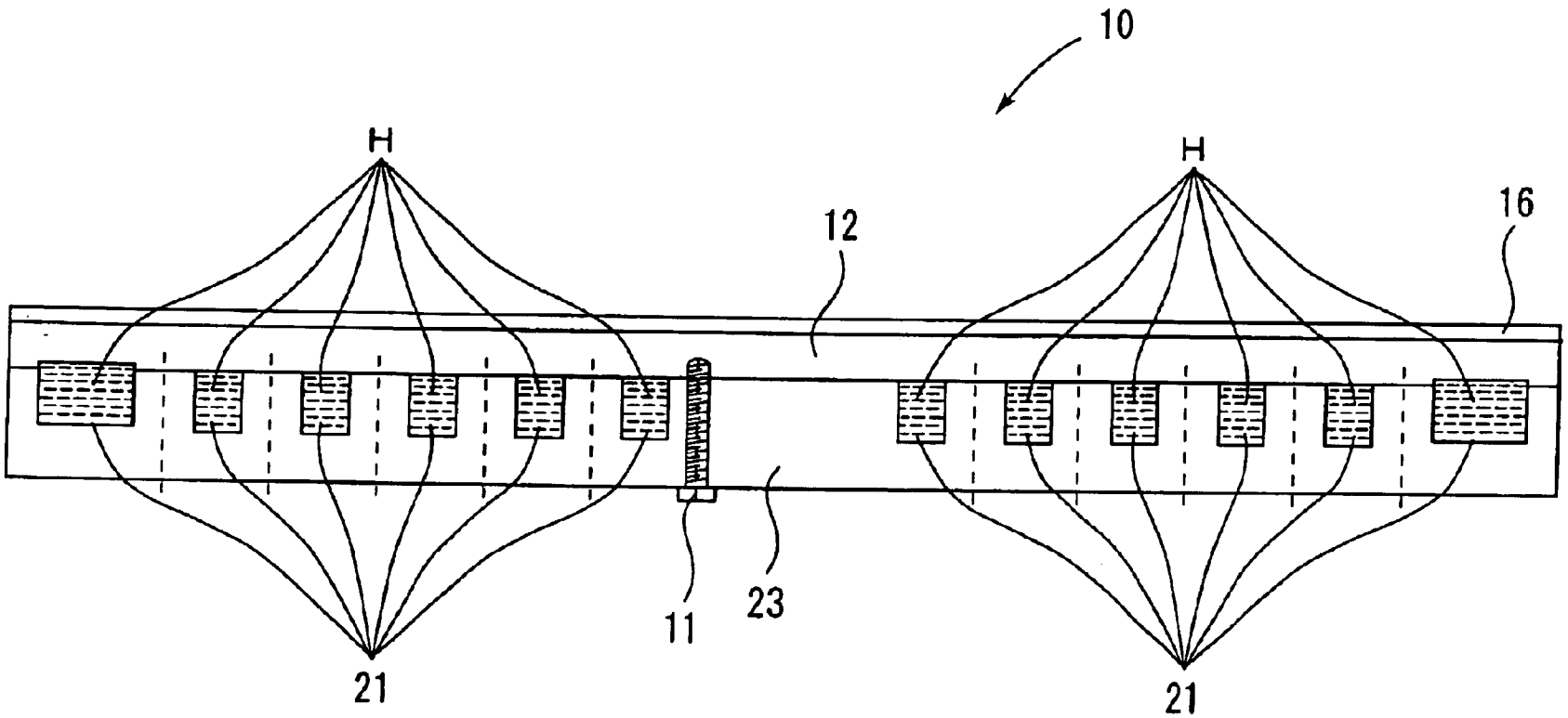
FIG. 20 is an explanatory sectional view showing an example of a prior art polishing table.

Fundamental construction of the polishing apparatus is as follows:

1. Polishing Table: As shown in FIGS. 16 and 17, an upper table 12 (made of an SUS410 flat plate) and a lower table 23 made of cast iron (FC-30) on an upper surface of which recesses 21 serving as cooling water paths are formed are placed over on the other and fastened with clamping members 11 to fabricate a polishing table 10.
2. Work Holding Plate: As shown in FIG. 18, the work holding plate 13 made of alumina ceramics is pressed downward by an upper load 15 provided with a rotary shaft 18 with a rubber elastic member 13*a* interposed therebetween.
3. Polishing Cloth: SuBa600 made by Rodel Co. was adhered on the upper surface of the polishing table 10.
4. Other Performance of Polishing Apparatus:
   a) unevenness in rotation of the polishing table: ±2%
   b) displacement in rotation of the polishing table surface: 30 μm, and
   c) displacement in rotation of the polishing table rotary shaft: 140 μm.
5. An integrated heat quantity control system was constructed as shown in FIGS. 14 and 15. FIGS. 14 and 15 are similar to the construction of FIGS. 8 and 9 except that none of a temperature adjusting fluid supply system of the work holding plate, a polishing table rotary shaft temperature adjusting fluid system, and a work holding plate rotary shaft temperature adjusting fluid system exist; therefore, repeated descriptions thereof are omitted.
6. Outlines of Polishing Operation:

In a similar way to Example 1, a total 20 wafers (each having a diameter 200 mm and a thickness 750 mm) were adhered and held such that each set of five wafers is placed on each of 4 work holding plates each having a diameter 565 mm and centers of the wafers of each set are equidistantly located almost on a circle with a radius (175 mm) of ⅔ times a radius of a work holding plate from the center thereof.

Figure 21:
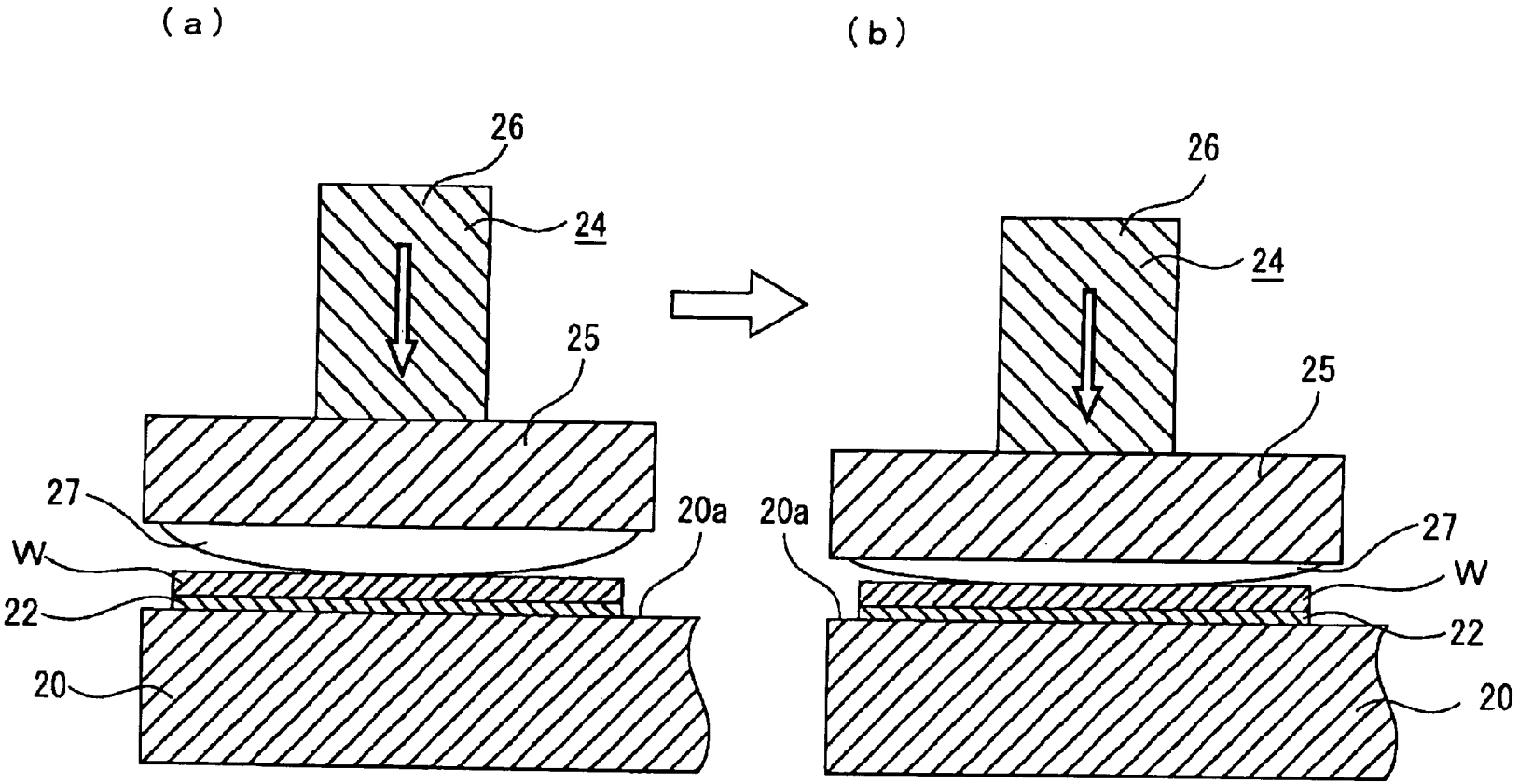
FIG. 21 is an explanatory schematic view showing an example of a prior art method for adhering wafer onto a work holding plate, where (a) shows a state prior to application of pressure and (b) shows a state of adhesion under pressure.
Figure 22:
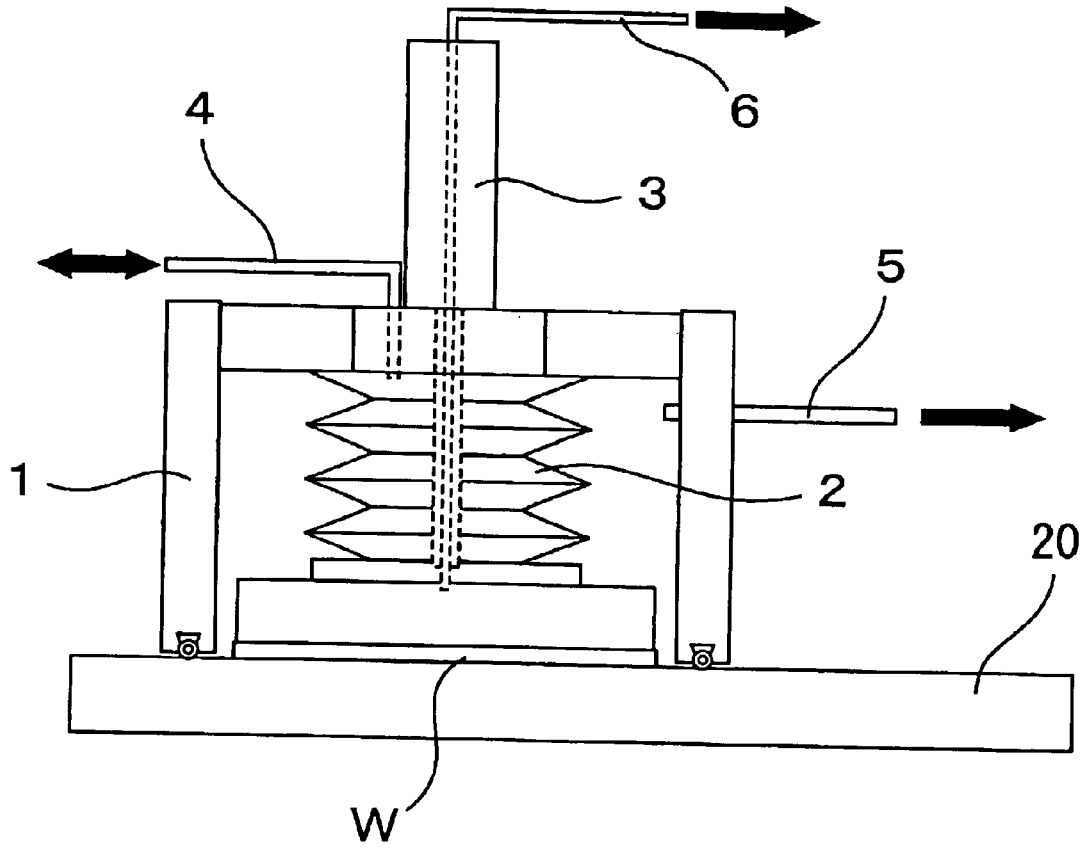
FIG. 22 is an explanatory schematic view showing another example of a prior art method for adhering a wafer onto a work holding plate.

Adhering of a wafer was performed as follows: A beeswax adhesive SKYLIQUID HM-4011 made by Nikka Seiko K.K. was dissolved into isopropyl alcohol and applied on a to-be-adhered surface (rear surface) of each wafer with a spin coater in advance, and thereafter, the wafer is heated to 50° C. and held at the temperature for about 0.5 min to evaporate and remove the solvent. Thereafter, the wafer was further heated to about 90° C. to melt the wax (a viscosity of 1000 mP·s at 90° C.); subsequently, the wafer was placed at a prescribed position on a work holding surface of the work holding plate heated equally to 90° C.; an adhering tool of a rubber elastic member in the shape convex outwardly shown in FIG. 21 was pressed onto the to-be-polished surface (a front surface) of the wafer such that air is expelled from the adhesion layer in the adhering portion to the outside. After that, the adhering tool was taken off and the wafer was allowed to cool to room temperature.

In the case where the adhesion was performed by means of the above-described method, the work holding plate and the wafer were adhered each other in a state heated at 90° C.; therefore, an average thickness of the adhesive layer was in the range of 0.3 to 0.8 μm on every wafer and a deviation of the thickness was on the order of 0.1 μm within one wafer because of deformation due to differences in thermal expansion coefficient between the wafer, the work holding plate and the wax, unevenness in application of a pushing force by the rubber elastic member and others.

7. Polishing Conditions:

(1) Polishing Table:

Rotational frequency: 30 rpm±2%,

Cooling Water: 15 l/min,

Inlet Temperature: 12° C.±1° C., and

Outlet Temperature: not controlled.

(2) Work Holding Plate (free rotation)

Load Added: 250 g per $cm^2$ of wafer surface.

(3) Polishing Solution:

AJ-1325, pH: 10.5 to 10.8, $SiO_2$ content: 20 g/l, specific gravity: 1.02 to 1.03 (a trade name of a colloidal silica polishing agent made by Nissan Chemical Industries, Ltd.) and Supply Amount: 10 l/min.

Supply Side Outlet Temperature: 23° C.±1° C.

(4) Polishing Time: 10 min (5) Polishing Removal: 10 μm

Figure 12:
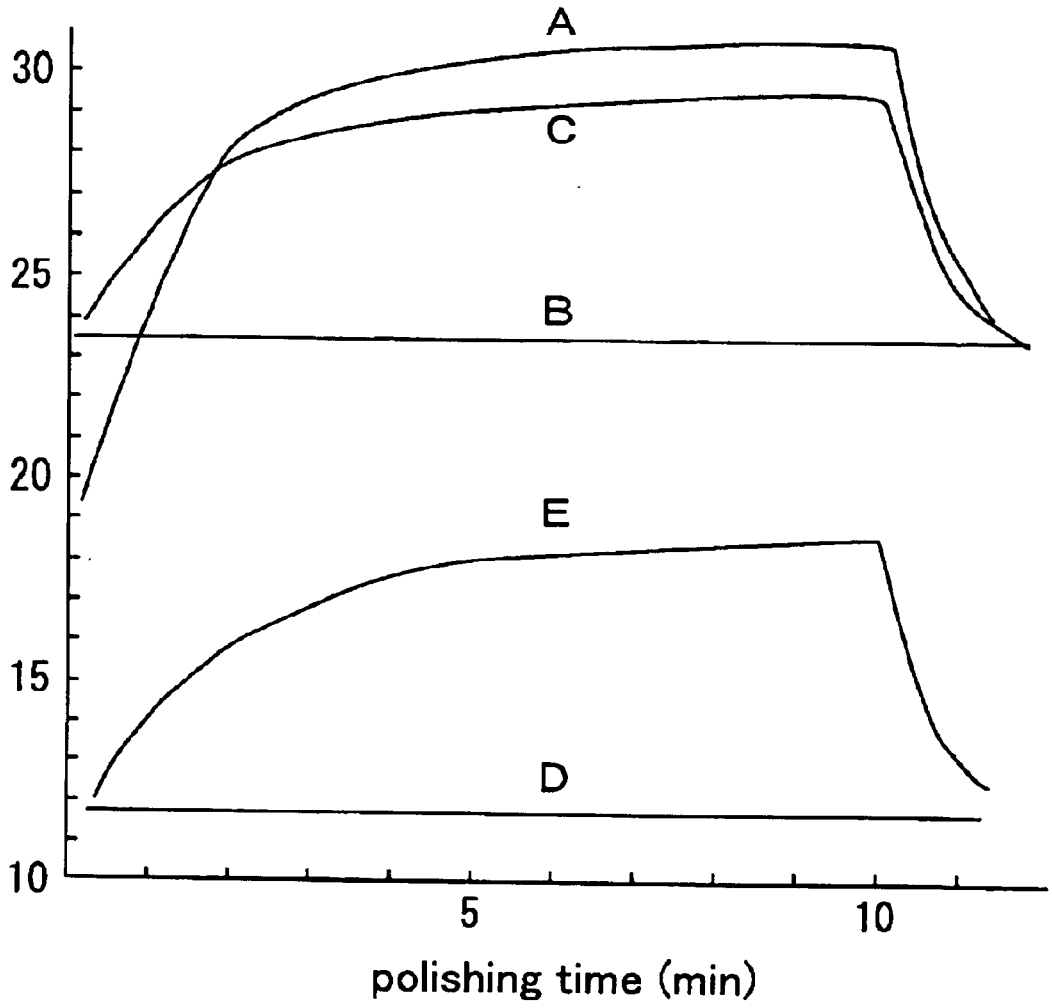
FIG. 12 is a graph showing relationships between a polishing time and a polishing cloth surface temperature, a polishing agent solution supply temperature, a polishing agent solution return temperature, a polishing table cooling water supply temperature, and a polishing table cooling water return temperature in Comparative Example 1.
Figure 13:
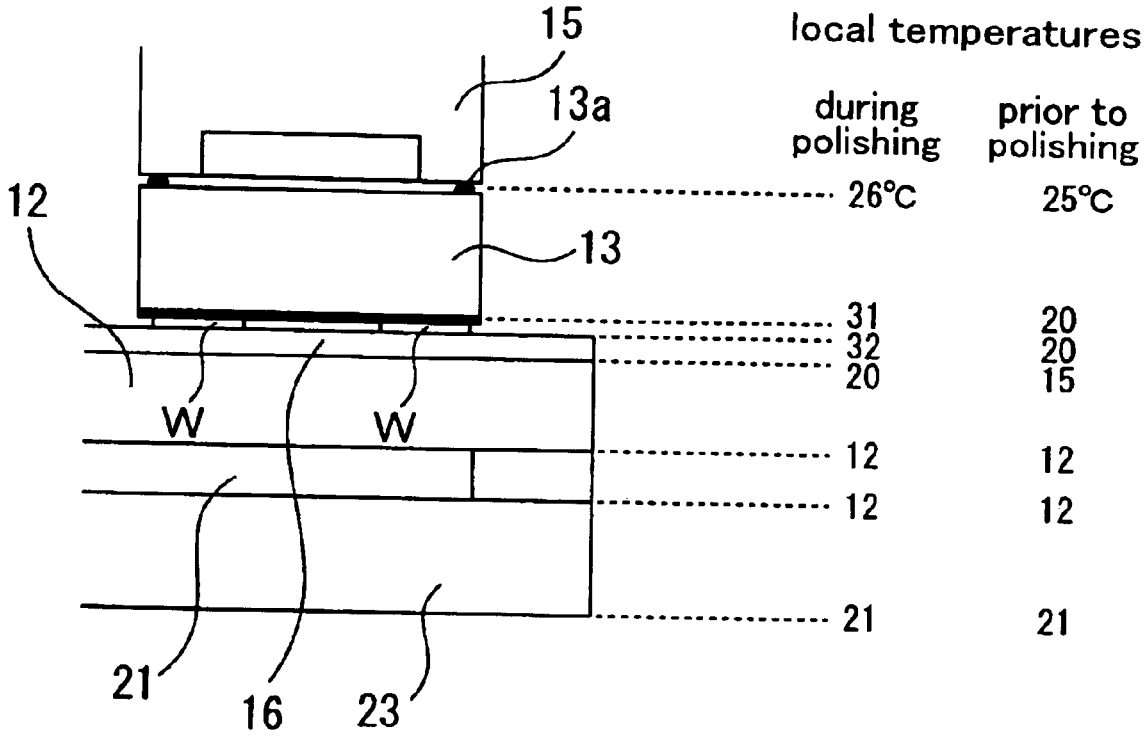
FIG. 13 is an analytical view of a temperature distribution in the range of from a rear surface of a work holding plate to a lower surface of a polishing table in Comparative Example 1.

Temperature control of a cooling water system is performed by the integrated heat quantity control system shown in FIGS. 14 and 15 and a progress in the polishing operation is shown in FIG. 12. While a temperature on the front surface of the polishing cloth was measured using the thermal image sensor in a similar way of Example 1, in this case no control was especially performed on the surface temperature of the polishing cloth which is left alone. Such changes in the surface temperature of the polishing cloth at this time are shown in FIG. 13 and the temperature rose from about 20° C. prior to the polishing to about 32° C. after completion of the polishing. A temperature distribution from the work holding plate to the polishing table in this case is analyzed as shown in FIG. 13; temperature changes were experienced to be 10° C. or more after the polishing when compared with the temperature distribution prior to the polishing. Thereby, an amount of thermal deformation of the polishing table in a direction normal thereto amounts to locally 100 μm or more as shown in FIG. 23(*c*).

Polishing finish precision of the wafers thus processed resulted at a lower level compared with Example 1 as shown in Table 1.

Capability of Exploitation in Industry

As described above, according to a polishing apparatus and a polishing method of the present invention, high precision polishing of a work, such as a wafer having a diameter of, for example, 8 inches to 12 inches or more can be attained with high efficiency. Furthermore, according to a method for adhering a work of the present invention, a work, for example, a wafer can be uniformly adhered without producing deformation of a work holding plate, thereby an effect serving as an aid for realizing high precision polishing of a wafer being achieved.

What is claimed is:

1. A polishing apparatus comprising:

a polishing table; and a work holding plate, wherein a work held on the holding plate is polished supplying a polishing agent solution, and the polishing table is formed in one-piece by casting, a structure of the polishing table is such that a plurality of recesses and/or a plurality of ribs are provided on a rear surface thereof, a flow path for a temperature adjusting fluid is formed inside for the polishing table, portions in each of which the flow path is not formed act as an internal rib structure, and a value of a thermal expansion coefficient of a material of the polishing table is $5\times10^{-6}$/° C. or less and corrosion resistance of the material is almost equal to that of stainless steel.

2. A polishing apparatus according to claim 1, wherein the material of the polishing table is invar.

3. A polishing apparatus according to claim 1, wherein temperature changes at any position of a polishing surface of a polishing cloth in polishing action are controlled to 10 ° C. or less by controlling a temperature and/or a flow rate of the polishing agent solution.

4. A polishing apparatus according to claim 1, wherein rotational unevenness of the polishing table is restricted to 1% or less.

5. A polishing apparatus according to claim 1, wherein surface displacement in rotation of a polishing surface of the polishing table is restricted to 15 μm or less.

6. A polishing apparatus according to claim 1, wherein displacement in rotation of a rotary shaft of the polishing plate is table is restricted to 30 μm or less.

7. A polishing apparatus comprising:

a polishing table; and a work holding plate, wherein a work held on the holding plate is polished supplying a polishing agent solution, and the polishing table is formed in one-piece by casting, a structure of the polishing table is such that a plurality of recesses and/or a plurality of ribs are provided on a rear surface thereof, a flow path for a temperature adjusting fluid is formed inside for the polishing table, portions in each of which the flow path is not formed act as an internal rib structure, and the work holding plate has recesses or a rib structure formed on a rear surface thereof opposite said working surface.

8. A polishing apparatus according to claim 7, wherein a material of the work holding plate is alumina ceramics or SiC.

9. A polishing apparatus according to claim 8, wherein a plurality of fine holes for vacuum chucking a work are opened in a region of the work holding plate where the work is adhered.

* * * * *